US005559762A

United States Patent [19]

Sakamoto

[11] Patent Number: 5,559,762

[45] Date of Patent: Sep. 24, 1996

[54] ELECTRONIC CLOCK WITH ALARM AND METHOD FOR SETTING ALARM TIME

[75] Inventor: Yumi Sakamoto, Nagano-ken, Japan

[73] Assignee: Seiko Epson Corporation, Tokyo, Japan

[21] Appl. No.: 466,496

[22] Filed: Jun. 6, 1995

[30] Foreign Application Priority Data

Jun. 22, 1994 [JP] Japan ..... 6-140468

[51] Int. Cl.[6] ..... G04B 23/02

[52] U.S. Cl. ..... 368/74; 368/251

[58] Field of Search ..... 368/72–74, 109, 368/113, 185–188, 250, 251

[56] References Cited

U.S. PATENT DOCUMENTS

| | | | |
|---|---|---|---|
| 4,095,410 | 6/1978 | Kaneko | 368/73 |
| 4,269,025 | 5/1981 | Kondo | 368/73 |
| 4,444,512 | 4/1984 | Piguet et al. | 368/72 |
| 4,681,465 | 7/1987 | Nakamura et al. | 368/74 |
| 5,008,866 | 4/1991 | Thinesen | 368/21 |
| 5,226,022 | 7/1993 | Thinesen | 368/22 |

FOREIGN PATENT DOCUMENTS 5-198603 8/1993 Japan .

*Primary Examiner*—Vit W. Miska
*Attorney, Agent, or Firm*—Stroock & Stroock & Lavan

[57] ABSTRACT

An electronic alarm clock including a clock timing circuit for counting the basic time, an alarm time setting circuit for setting an alarm time and an alarm time storing circuit storing said alarm time. The electronic alarm clock also includes an alarm coincidence detecting circuit for detecting the coincidence between the basic time and the alarm time stored in said alarm timing storing circuit, an alarm setting/resetting circuit and an alarm sounding control circuit for causing an alarm sounding circuit to sound when said alarm setting/resetting circuit is set and said alarm coincidence detecting circuit detects the coincidence between said basic time and said alarm time.

16 Claims, 14 Drawing Sheets

100

102
OSCILLATOR CIRCUIT
104
105
FREQUENCY DIVIDING CIRCUIT
ø
130
INTERRUPTION CONTROL CIRCUIT
106
134
140
CONTROL CIRCUIT
108
RAM
ALARM TIME MEMORY
ROM
132
INPUT CONTROL CIRCUIT
DISPLAY CONTROL CIRCUIT
ALARM CONTROL CIRCUIT
112
136
138
GROUP OF SWITCHES
LCD PANEL
ALARM SOUNDING CIRCUIT
122
120
124

ELECTRONIC CLOCK WITH ALARM AND METHOD FOR SETTING ALARM TIME

BACKGROUND OF THE INVENTION

The present invention relates to a method for setting an alarm time of an electronic alarm clock and an alarm sounding operation and, more particularly, to an improved electronic alarm clock that can more easily and accurately set an alarm time that is relatively close in time to the current (i.e., actual) time.

A conventional electronic alarm clock typically has two modes: an alarm mode and a non-alarm mode. Regardless of whether the clock is in the alarm mode or non-alarm mode (i.e. whether the alarm has been set to ON or reset to OFF), the alarm time remains the same alarm time as that previously set and will indicate the alarm time which had been previously set. Further, the conventional electronic alarm clock is also designed to sound its alarm after a certain period of time after the alarm previously sounded and the current time reaches the alarm time which has been set again.

However, when it is desired to set the alarm to sound at a time which, for example, is relatively close in time to the current time, this type of conventional electronic alarm clock is inconvenient. Specifically, if the alarm time, which had been previously set, is far apart from the current time, the actual physical time it takes to set a newly desired alarm time presents a problem if the new alarm time is close to the current time. As a result, one is not able to very quickly reset the alarm on the conventional alarm clock.

To solve the aforesaid problem, it is known in the art from Japanese Patent Application No. 5-198603 to set the alarm time by adding one minute to the current time and for indicating the set alarm time in the alarm time setting mode. This makes it possible for an electronic alarm clock to have its alarm time set relatively close to the current time.

However, the prior art is still deficient in certain respects. For example, if the alarm time setting switch is accidentally pressed, the alarm time is set for the current time plus one minute. As a result, an unwanted alarm will be sounded within a minute from the moment the alarm time setting switch is accidentally pressed. This causes such problems as a useless noise, a nuisance or frustration to the user, and shortened battery life due to the wasteful consumption of current by the sounding alarm.

Still further, the alarm time setting mode is undesirably switched to another mode immediately if the alarm time is decremented while the clock is in the alarm time setting mode until the current time matches the alarm time or when resetting the alarm sound to OFF. The sudden change from the alarm time setting mode to another mode tends to confuse the user and it is inconvenient to the user.

Accordingly, an electronic alarm clock that solves the aforementioned problems and still further improves the state of the art over that described in Japanese Patent Application No. 5-198603 is desired. Further, a user-friendly electronic alarm clock which permits easy setting of an alarm time that is relatively close to the current time is also desired.

SUMMARY OF THE INVENTION

The electronic clock with alarm in accordance with the present invention is characterized in that it has the alarm time setting mode for setting an alarm time, the alarm time automatically follows the current time if no alarm time has been set, and it is equipped with a unique alarm setting/resetting circuit and alarm sounding control circuit.

Generally speaking, in accordance with the present invention, an electronic clock with an alarm is provided. The clock includes a clock timing circuit for counting the basic time (i.e., current time) and an alarm time setting circuit for setting an alarm time placing the clock in an alarm time setting mode. The clock also includes an alarm time storing circuit for storing the alarm time and an alarm coincidence detecting circuit for detecting the coincidence between the basic time and the alarm time stored in the alarm timing storing circuit. An alarm setting/resetting circuit receives an output from the alarm coincidence detecting circuit and alarm time setting circuit and outputs a signal corresponding to the mode. An alarm sounding circuit receives inputs from the alarm setting/resetting circuit and alarm coincidence detecting circuit. The alarm setting/resetting circuit being in a set state when the alarm coincidence detecting circuit detects that the basic time and the alarm time no longer coincide with each other, and being in a reset state when the alarm coincidence detecting circuit detects the coincidence between the basic time and the alarm time. The alarm setting/resetting circuit causing the basic time to be stored in the alarm time storing circuit while in a reset state. An alarm sounding control circuit for actuating the alarm sounding circuit to sound the alarm when the alarm setting/resetting circuit is set and the alarm coincidence detecting circuit detects the coincidence between the basic time and the alarm time.

The alarm setting/resetting circuit is characterized by its setting/resetting conditions. The alarm setting/resetting circuit is set when the alarm time setting mode is effected and an alarm coincidence detecting circuit detects that the alarm time, which has been set through the alarm time setting circuit by pressing the alarm time setting mode switch, no longer agrees with the current time. Likewise, the alarm setting/resetting circuit is reset when the alarm coincidence detecting circuit detects the coincidence between the set alarm time and the current time. Further, when the alarm setting/resetting circuit is in the reset condition, the current time is stored in an alarm time storing circuit for storing an alarm time, so that the alarm time agrees with the current time.

The following provides a summary of the set/reset conditions of the alarm setting/resetting circuit.

The alarm setting-resetting circuit is set when the alarm time setting mode is effected and an alarm time, which is different from the current time, is set using an input switch. Under this set condition, the set state remains unchanged even if the alarm time setting mode is switched to another mode. If, however, the elapsing time causes the set alarm time to reach the current time in another mode, then the alarm is sounded and the alarm setting/resetting circuit is reset. After that, the reset state is maintained until the alarm time setting mode is effected again.

When the alarm time setting mode is effected and the same alarm time as the current time is set using the switch, the alarm setting/resetting circuit is in the reset state. This reset state remains unchanged even if the alarm time setting mode is replaced by another mode.

The alarm sounding control circuit is characterized by its alarm sounding conditions. More specifically, the alarm sounding control circuit sounds the alarm when the alarm setting/resetting circuit is set. Then the alarm coincidence detecting circuit detects that the alarm time, which has been set, agrees with the current time. In other words, after the alarm time, which is different from the current time, is set using the switch, when the time passes until it reaches the set alarm time, the alarm is sounded. The alarm, however, is not sounded even if the alarm coincidence detecting circuit detects the coincidence between the set alarm time and the current time if the mode is switched to the alarm time setting mode and the set alarm time is made to coincide with the current time by using the switch rather than by the lapse of time.

The alarm is sounded as described above. However, when an alarm time is set which is different than the current time, the alarm setting/resetting circuit is switched from the set state to the reset state after the alarm is sounded. Accordingly, no alarm is sounded under the reset condition; therefore, once the alarm is sounded, the condition is automatically switched to the condition under which no alarm is sounded. The electronic clock with alarm in accordance with the present invention is characterized by the provision of such "one-time alarm". In the prior art, the set alarm time does not change and therefore, the alarm is sounded each time the predetermined time elapses. Preventing the unwanted alarm sounding required an additional operation. According to the present invention, however, the condition is automatically switched to the one under which no alarm is sounded, thus eliminating the need for such an additional operation.

It is also possible to prevent the alarm setting/resetting circuit from being reset after the alarm is sounded. In a preferred embodiment, it is also possible to provide the "repeatable alarm" so that the alarm is sounded every time the set time is reached. The present invention enables, therefore, the selection between the resetting and maintaining the set condition through circuitry provided for selecting whether the alarm setting/resetting circuit is to be reset or not.

In a preferred embodiment, the electronic clock with alarm is equipped with a reset time counting circuit for counting the time during which the aforesaid alarm setting/resetting circuit stays in the reset state and also a condition control circuit for preventing the alarm time from being set when the reset time counting circuit reaches a predetermined value. This embodiment makes it possible to prevent unwanted alarm sounding even if the alarm time setting mode switch is pressed by mistake. More specifically, just pressing the alarm time setting mode switch does not set the alarm setting/resetting circuit although the mode is changed to the alarm time setting mode. Hence, under such a condition, the alarm does not sound. With the condition maintained, the moment the value of the reset time counting circuit, which measures the time, reaches a predetermined value, an alarm time changing mode is automatically replaced by another mode, so that no alarm time is allowed to be set.

The electronic clock with alarm also includes an alarm time setting circuit for fast forwarding the alarm time by pressing and holding down an input switch, which is used to set the alarm time, in the alarm time setting mode and for stopping the fast forwarding of the alarm time when a set alarm time coincides with the current time.

The electronic alarm clock includes an input control circuit for detecting whether the switch has been operated or not, an edge input detecting circuit for detecting whether a switch input detected by the input control circuit is an edge input or not, and a press-and-hold-down input detecting circuit for detecting whether the switch input detected by the input control circuit is the press-and-hold-down input. The alarm time setting circuit increments or decrements the alarm time by a predetermined unit amount when the edge input detecting circuit detects the edge input and fast forwards the alarm time by the fast forward control circuit while the press-and-hold-down input detecting circuit is detecting the press-and-hold-down input. It is also understood that the alarm time can be set by "fast rewinding" the alarm time. That is, the alarm time can be set by decrementing the alarm time so as to set a desired alarm time instead of fast forwarding the alarm time to reach the desired alarm time. The alarm time setting circuit is further designed to stop the fast forwarding of the alarm time when the alarm coincidence detecting circuit detects the coincidence between a set time and the current time.

Accordingly, the alarm time to be set, which is being fast forwarded, always stops at the current time. Accordingly, the alarm time remains unchanged even if the switch is held down after the current time is reached. Thus, the alarm time chan be changed only after the switch is released once and then pressed again. This makes it possible to set a required alarm time from the current time, permitting easy setting of the alarm time which is relatively close to the current time. The feature is especially useful for setting the alarm time many times. Moreover, combining the feature with the aforesaid alarm setting/resetting circuit, which is reset when the set alarm time agrees with the current time, permits very easy alarm setting.

In addition a method for setting an alarm time in an electronic clock is provided. The method includes the steps of placing the electronic clock in a first mode by triggering a switch input, setting an alarm time when the electronic clock is in the first mode, preventing the alarm time from being set when the electronic clock is in a second mode, and counting the duration during which the basic time clocked by the basic clock timing circuit coincides with the alarm time when the electronic clock is in said first mode. The method also includes changing the first mode to the second mode when the duration reaches a predetermined value.

Accordingly, it is an object of the present invention to provide an improved electronic alarm clock.

It is another object of the present invention to provide an electronic alarm clock that is user friendly and easy to program.

It is another object of the present invention to prevent an unwanted alarm from sounding even if the alarm time setting mode switch is accidentally pressed.

It is still another object of the present invention to eliminate the inconveniences to the user and thereby to improve the operability when the alarm time setting mode is replaced by another mode.

Still other objects and advantages of the invention will in part be obvious and will in part be apparent from the specification and drawings.

The invention accordingly comprises the several steps and the relation of one or more of such steps with respect to each of the others, and the apparatus embodying features of construction, combination of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
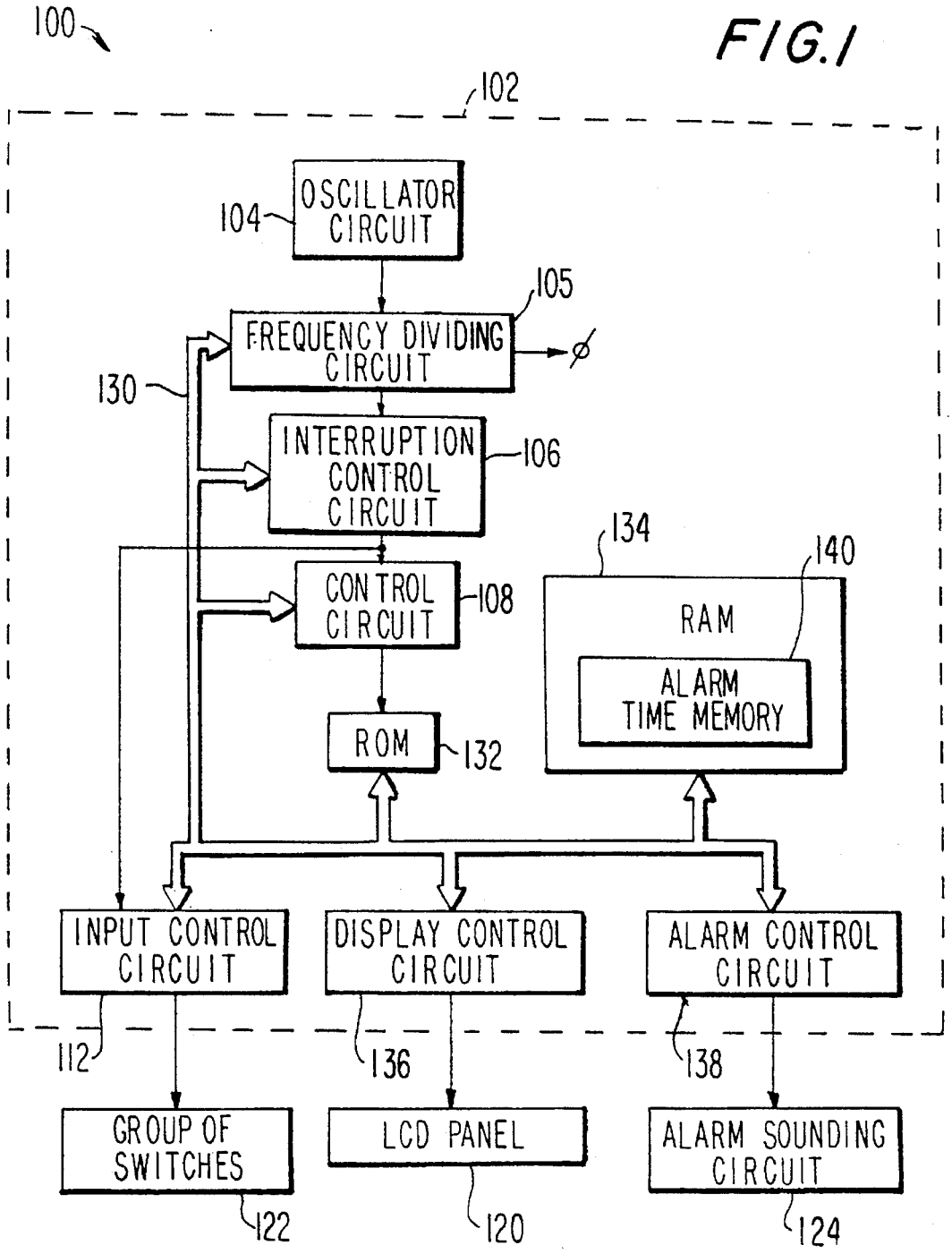
FIG. 1 is a block diagram of an electronic alarm clock constructed in accordance with the present invention.

Reference is made to FIG. 1 which illustrates the block diagram of the an electronic alarm clock, generally indicated as 100, constructed in accordance with the present invention. Electronic clock 100 includes a microprocessor 102, an LCD panel 120 for displaying the output of microprocessor 102, a plurality of switches 122 operatively coupled to microprocessor 102 providing inputs to microprocessor 102, and an alarm sounding circuit 124 driven by microprocessor 102.

Microprocessor 102, which controls electronic clock 100, includes an oscillating circuit 104. Oscillating circuit 104 provides an output to frequency dividing circuit 105. Frequency dividing circuit 105 outputs a divided clock signal to interrupt control circuit 106. Interrupt control circuit 106 provides an output to control circuit 108 and input control circuit 112. Control circuit 108 operates in accordance with instructions stored in ROM 132. Input control circuit 112 receives a second input from switches 122. A display control circuit 136 for controlling LCD panel 120 and an alarm control circuit 138 for controlling the alarm sounding circuit 124 are each interconnected with input control circuit 112, a RAM 134, ROM 132, control circuit 108, interrupt control circuit 106 and frequency dividing circuit 105 along an internal BUS 130.

Microprocessor 102 utilizes an output of oscillating circuit 104, which is divided by frequency dividing circuit 105, as a system clock of microprocessor 102. Another output of frequency dividing circuit 105 is supplied to an interrupt control circuit 106 along BUS 130 where it is used as an interrupt timing signal. Interrupt control circuit 106 controls the interrupt by a signal inside microprocessor 102 and an external signal, which are not shown, and interrupt control circuit 106 is connected to an input control circuit 112 and a control circuit 108. Control circuit 108 controls the start and stop and other operations of microprocessor 102. Control circuit 108 also controls the setting of an alarm time in accordance with the present invention.

Internal BUS 130 interconnects control circuit 108, a ROM 132 for storing the program to control the operation of electronic clock 100, a RAM 134 for storing various data required for the operation of electronic clock 100, a display control circuit 136 for controlling the display related to electronic clock 100, input control circuit 112 for monitoring the states of plurality of switches 122 and for controlling the switch inputs, and an alarm control circuit 138 for controlling the sounding of alarm sounding circuit 124. Alarm sounding circuit 124 may be a piezoelectric buzzer, by way of example, although other circuits are contemplated, such as an acoustic speaker, bell, tuning fork, vibrator or the like, as long as they can sound or vibrate at a predetermined frequency to notify an operator (i.e., user).

Since the frequency dividing circuit 105 is connected to internal bus 130, the state of the frequency dividing circuit 105 can be read by computer program. Similarly, since the interrupt control circuit 106 is connected to internal bus 130, the setting of an interrupt condition and reading of an interrupt factor can be performed by the computer program. A part of RAM 134 is equipped with an alarm time memory 140 which functions as an alarm time storing circuit. However, alarm time memory 140 need not necessarily be installed in RAM 134; it may alternatively be an independent memory or register, or it may be provided in a non-volatile RAM.

Figure 2:
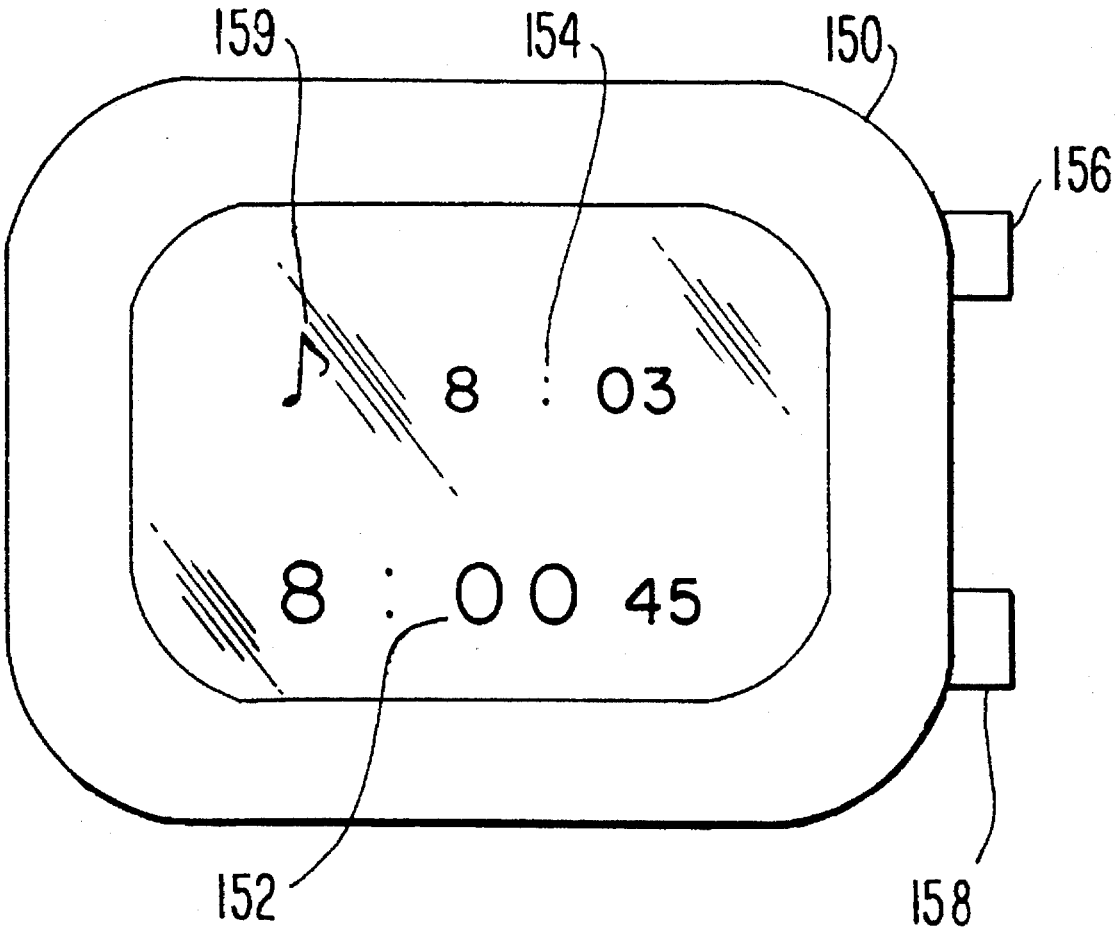
FIG. 2 is a plan view of an example of a display of the electronic alarm clock constructed in accordance with the present invention.

Display panel 120 and plurality of switches 122 will now be described with particular reference being made to FIG. 2. FIG. 2 depicts an alarm time set in the alarm time setting mode. LCD panel 120 is located essentially at the front central area of a main body 150 of electronic alarm clock 100 and is divided into a current time display area 152 and an alarm time display area 154. The current time display area 152 always shows the current time hours, minutes and seconds. In the alarm time setting mode, the alarm time display area 154 shows the time set by operating plurality of switches 122, which will be discussed further below. Once an alarm time has been set, the set alarm time remains displayed until the alarm is sounded, even in the basic clock mode (i.e. not in the alarm time setting mode). However, when the clock is in the basic clock mode but no alarm time has been set, the displayed alarm time is the same time as the displayed current time. In other words, the alarm time is displayed so that it automatically follows the current time.

There is yet another method for displaying the alarm time. For example, and as discussed further below, the alarm time is not displayed in the usual basic clock mode when the alarm time has not been set, but rather, displayed only in the alarm time setting mode. This is possible because the alarm time is identical to the current time in the basic clock mode when the alarm time has not been set, so there is no special need for displaying such duplicative time information.

Further, although this embodiment illustrates two display areas, namely, current time display area 152 and alarm time display area 154, only one display area may be required. The one display area may display the current time in the basic clock mode and the alarm time, rather than the current time, when in the alarm time setting mode. In this case, the display of the seconds should be OFF in the alarm time setting mode. The setting of the seconds of an alarm time to be set is hardly required, so that turning the display of the seconds OFF makes it easier to recognize whether the displayed time is the current time or the alarm time.

Furthermore, although the present invention employs LCD panel 120 as the display, the display is not limited thereto. The display may be, for example, a light emitting diode (LED), an electroluminescent element, a fluorescent display tube, a discharge tube, an incandescent lamp, a non-luminescent numeral display panel, or the like. Moreover, although the embodiment employs a digital display, an analog display may be used in place thereof.

Plurality of switches 122 includes a first external control switch 156 and a second external control switch 158 which may be pushbutton switches. When either one of the plurality of switches 122 is depressed, the alarm time setting mode is effected. When first external control switch 156 is depressed, the alarm time is set for the current time plus one minute and this set alarm time is displayed in the alarm time display area 154. When second external control switch 158 is depressed, the alarm time is set for the current time minus one minute and this set alarm time is displayed in the alarm time display area 154. When an alarm is set, an alarm set mark 159 is displayed in the alarm time display area 154. Alarm set mark 159 indicates that the sounding alarm has been set. Alarm set mark 159 turns OFF when the sounding alarm is reset as discussed further below.

First external control switch 156 and second external control switch 158 are preferably located on a side surface of main body 150. However, switches 156 and 158 may be located elsewhere on main body 150 as long as the location thereof does not interfere with the operation thereof. In general however, it is easier to operate switches 156 and 158 when they are located on the side surface of main body 150 rather than on the surface with LCD panel 120 (i.e., the surface with the display unit of main body 150). Therefore, it can be seen that the side surface of main body 150 is more desirable as the location for mounting switches 156 and 158, although they may be located on the display unit (i.e., the LCD panel) if the display unit is sufficiently large enough.

While the first embodiment may employ the use of pushbutton switches, other types of switches, such as slide switches and touch-sensitive switches, may be utilized. In fact, the use of touch-sensitive switches are preferred when the switches are to be mounted on the display unit.

Figure 3:
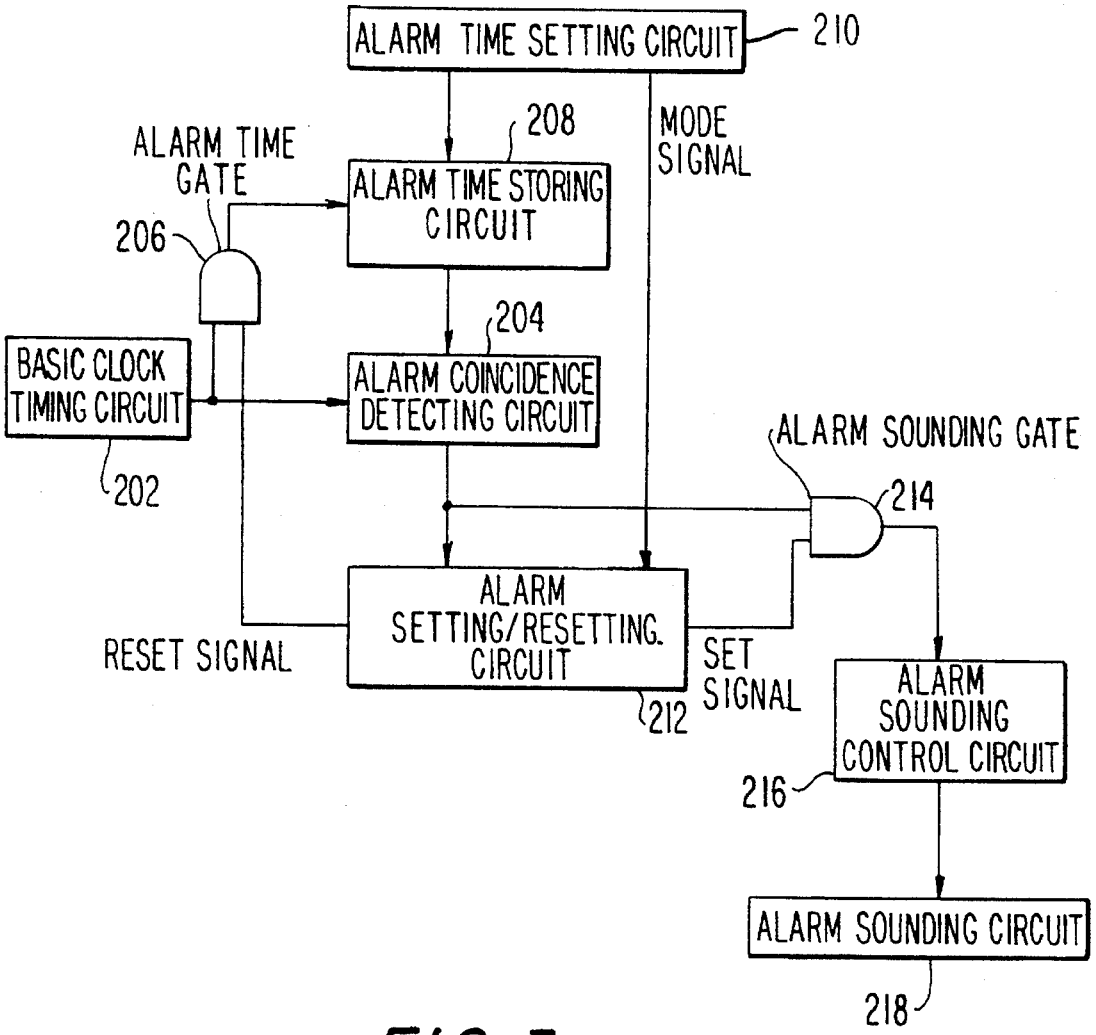
FIG. 3 is a block diagram of an electronic alarm clock constructed in accordance with a first embodiment of the present invention.

The operation of the electronic alarm clock in accordance with the present invention will now be described with reference to FIG. 3. FIG. 3 depicts a basic clock timing circuit 202 having the timing function of clock 100. The timing information (i.e., the current time), generated by the basic clock timing circuit 202, is displayed in the current time display area 152 (FIG. 2). The time information is also supplied to an alarm time gate 206 and an alarm coincidence detecting circuit 204.

An alarm time storing circuit 208 (i.e., the alarm time memory 140 shown in FIG. 1) stores either an arbitrary alarm time set by an alarm time setting circuit 210 or the time information generated by basic clock timing circuit 202 through alarm time gate 206. The alarm time setting circuit 210 is designed so that an alarm time can be set using an input switch (i.e., first external control switch 156 or second external control switch 158 shown in FIG. 2). The alarm time setting circuit 210 outputs an alarm time setting mode signal which indicates that alarm time setting circuit 210 has been actuated, causing alarm coincidence detecting circuit 204 to output a time coincidence detection signal, which will be described further below. When the alarm time setting circuit 210 has been actuated (set), the information stored in alarm time storing circuit 208 is displayed in alarm time display area 154 (FIG. 2) via display control circuit 136 depicted in FIG. 1.

The alarm time storing circuit 208 also provides an input to alarm coincidence detecting circuit 204. Alarm coincidence detecting circuit 204 detects whether the alarm time stored in alarm time storing circuit 208 agrees with the basic time provided by basic clock timing circuit 202.

An alarm setting/resetting circuit 212 receives the output (i.e., the time coincidence detecting signal) of alarm coincidence detecting circuit 204 and the output signal (i.e., the alarm time setting mode signal) of alarm time setting circuit 210. The time coincidence detecting signal of alarm coincidence detecting circuit 204 and the set signal indicating the state (set or reset) of alarm setting/resetting circuit 212 are provided as inputs to an alarm sounding gate 214. The alarm setting/resetting circuit 212 is set when the alarm time setting circuit 210 is outputting the alarm time set mode signal and when alarm coincidence detecting circuit 204 is not outputting the time coincidence detection signal, that is, when the set alarm time is different from the current time. This set state is maintained even after the outputting of the alarm time setting mode signal is stopped. Thereafter, the output of alarm sounding gate 214 changes state when the elapse of time causes alarm coincidence detecting circuit 204 to detect the coincidence between the alarm time and the current time. This actuates an alarm sounding control circuit 216 to drive an alarm sounding circuit 218 to sound an alarm for a predetermined time. Then, alarm setting/resetting circuit 212 is switched from the set state to the reset state. Alarm set mark 159 (FIG. 2) turns ON when alarm setting/resetting circuit 212 is set and turns OFF when alarm setting/resetting circuit 212 is reset.

Unless alarm setting/resetting circuit 212 is set, it is maintained in the reset state. As long as alarm setting/resetting circuit 212 is in the reset state, the reset signal is sent to alarm time gate 206. As a result, the output of alarm time gate 206 permits the information generated by basic clock timing circuit 202 (i.e., the basic time) to be stored in alarm time storing circuit 208. Therefore, the alarm time automatically follows the current time.

The operation of the circuit diagram of FIG. 3 will now be discussed in further detail with reference to the flowcharts of FIGS. 4 and 5.

Figure 4:
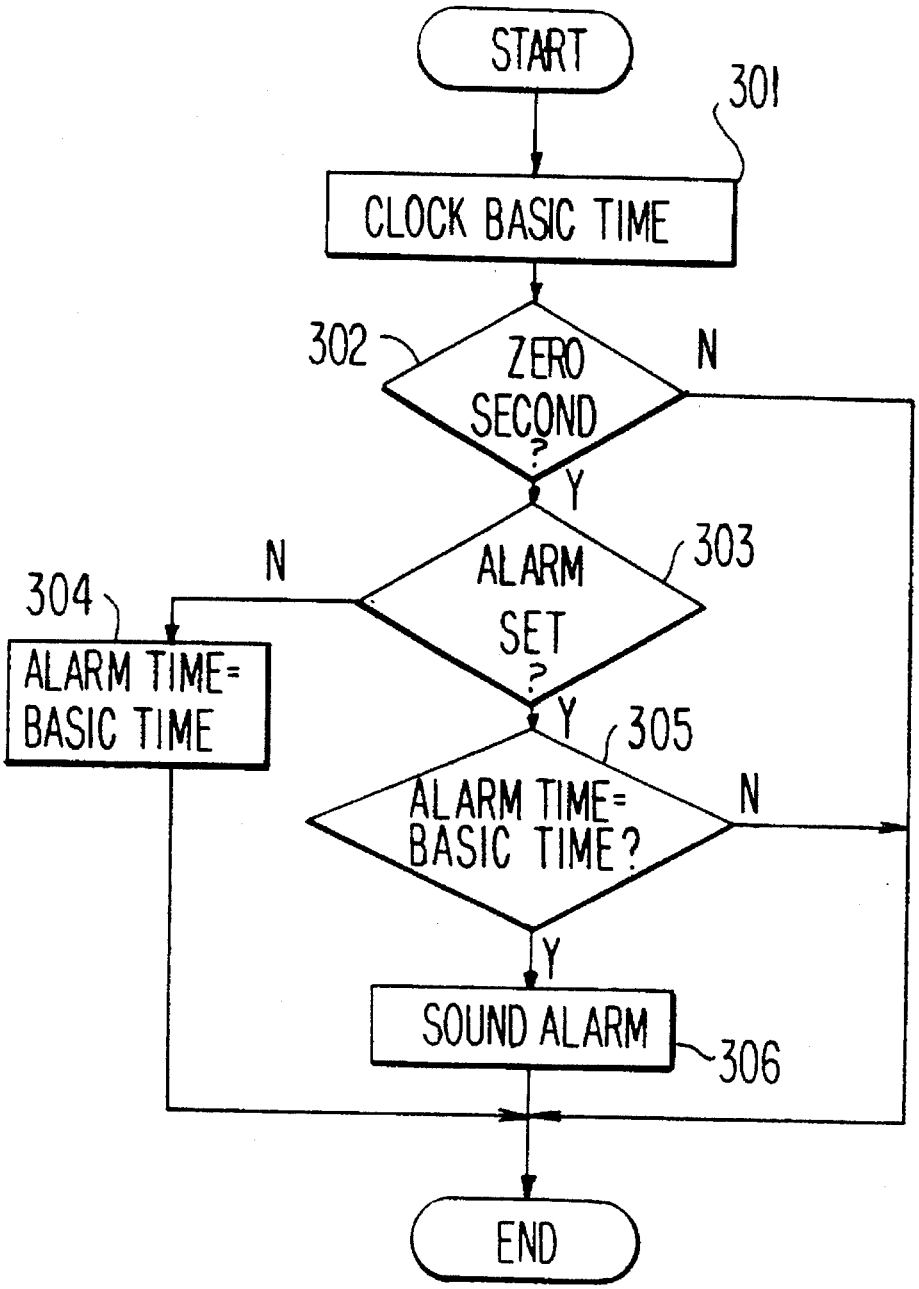
FIG. 4 is a flowchart of the operation of an electronic alarm clock in accordance with the first embodiment of the present invention.

The flowchart shown in FIG. 4 illustrates a basic program which is actuated when a 1 Hz interrupt is received through an interrupt control circuit 106 shown in FIG. 1. The significance of receiving the 1 HZ interrupt is that the program is implemented once per second. First, the basic time is timed by the basic clock timing circuit 202 (step 301) and the program determines whether the basic time is zero seconds (step 302) (i.e., whether the minute-digit count has occurred). At this time, if the basic time is zero seconds, then it is determined whether the alarm has been set (step 303) (i.e., whether alarm setting/resetting circuit 212 has been set). If the alarm has been set, then the program determines whether the alarm time is the same as the basic time (step 305). If the alarm time coincides with the basic time, the alarm is sounded (step 306).

If it is determined in step 303 that the alarm has not been set, that is, if alarm setting/resetting circuit 212 is in the reset state, then the basic time is stored in the alarm time memory 140 (FIG. 1) and the basic time is taken as the alarm time (step 304). Hence, the alarm time is identical to the basic time in the alarm reset state and the alarm time increments in synchronism with the basic time.

Figure 5:
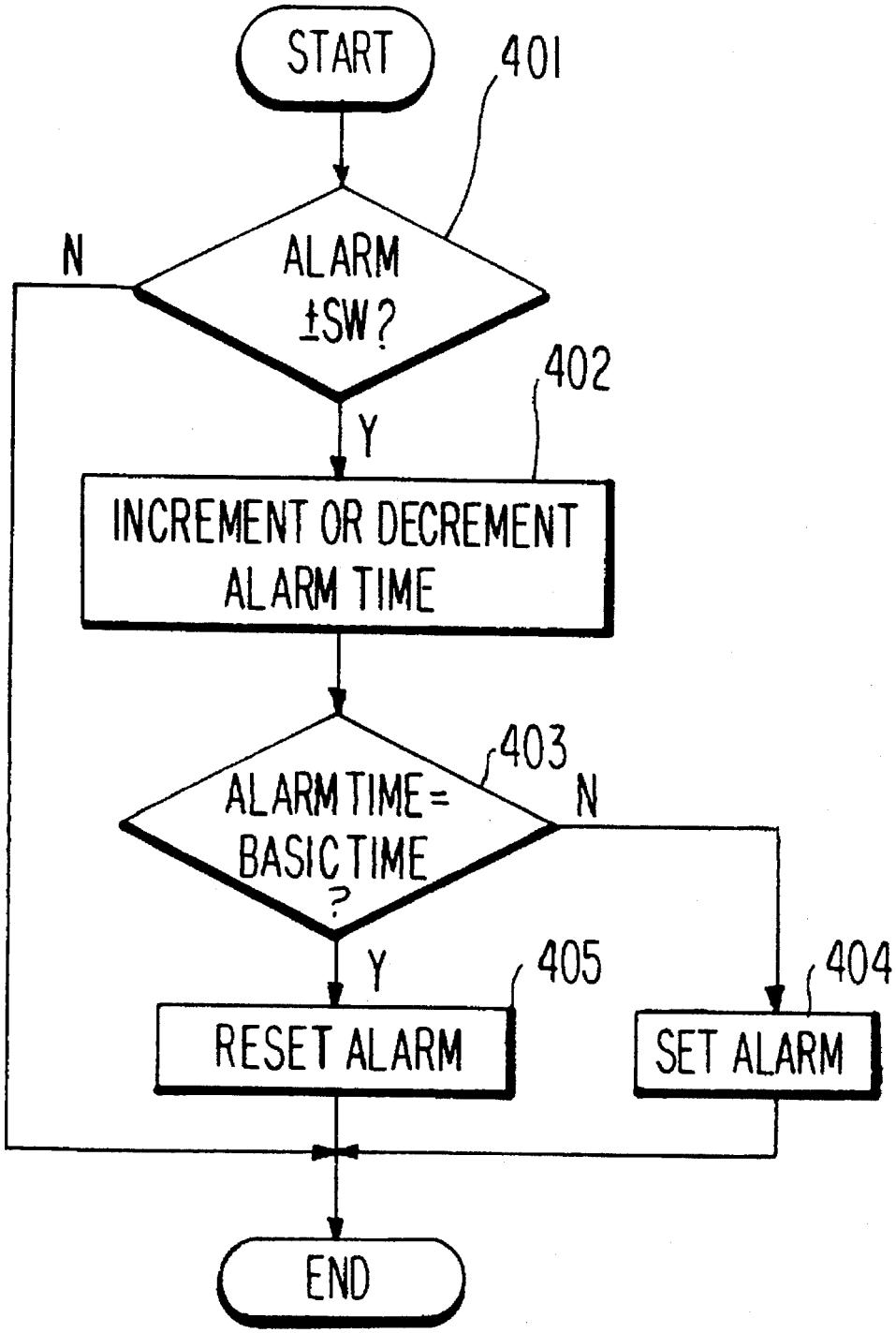
FIG. 5 is a flowchart for setting an alarm time in accordance with the first embodiment of the present invention.

FIG. 5 illustrates the operation of electronic alarm clock 100 in the alarm time set mode. First, in the basic clock mode, it is determined whether a switch input (i.e., either first external control switch 156 or second external control switch 158 (FIG. 2) for incrementing or decrementing the alarm time, respectively) is detected (step 401). If an input is detected, the alarm time set mode is effected and the alarm time is incremented or decremented depending on whether the first or second external control switch has been depressed (step 402). This configuration permits the alarm time to be changed by a user in increments or decrements of one minute. However, it is to be understood that the incremental or decremental periods of time are not limited to one minute. The period may be 10 minutes, one hour, one second, or the like, and only depends on the application of the invention to a particular alarm clock construction. The alarm time and the basic time are next compared by coincidence determining circuit 204 to determine if coincidence has occurred (step 403). If the alarm time and basic time are found to coincide, then alarm setting/resetting circuit 212 is reset (step 405). If the alarm time and basic time do not coincide, then alarm setting/resetting circuit 212 is set (step 404). Accordingly, regardless of whether step 404 or step 405 is reached, the alarm time setting mode is switched to the basic clock mode before the operation is completed.

For example, if the alarm time is set to 7:59 and the basic time is 8:00, and the incrementing switch (i.e., first external control switch 156/is depressed to cause the alarm time to be set to 8:00, then the alarm is reset. With this condition maintained, the alarm time becomes 8:01 when the basic time becomes 8:01 and the alarm time becomes 8:02 when the basic time becomes 8:02, as shown in and in accordance with FIG. 4. With both the basic time and the alarm time being 8:02, if the incrementing switch is depressed and the alarm time reaches 8:03, then the alarm is set. If this condition is maintained, the alarm is sounded when the basic time becomes 8:03 as shown in and in accordance with FIG. 4.

The electronic alarm clock in accordance with the first embodiment of the present invention can also be modified in a second embodiment as follows, with particular reference being made to FIG. 6. Like numerals are utilized to indicate like structures. The primary difference between the first and second embodiments being the control of the alarm sounding time, the interruption of the alarm sounding, and the resetting of the alarm setting/resetting circuit in accordance with the alarm sounding control circuit utilizing an alarm sounding time counting circuit and input control circuit.

Figure 6:
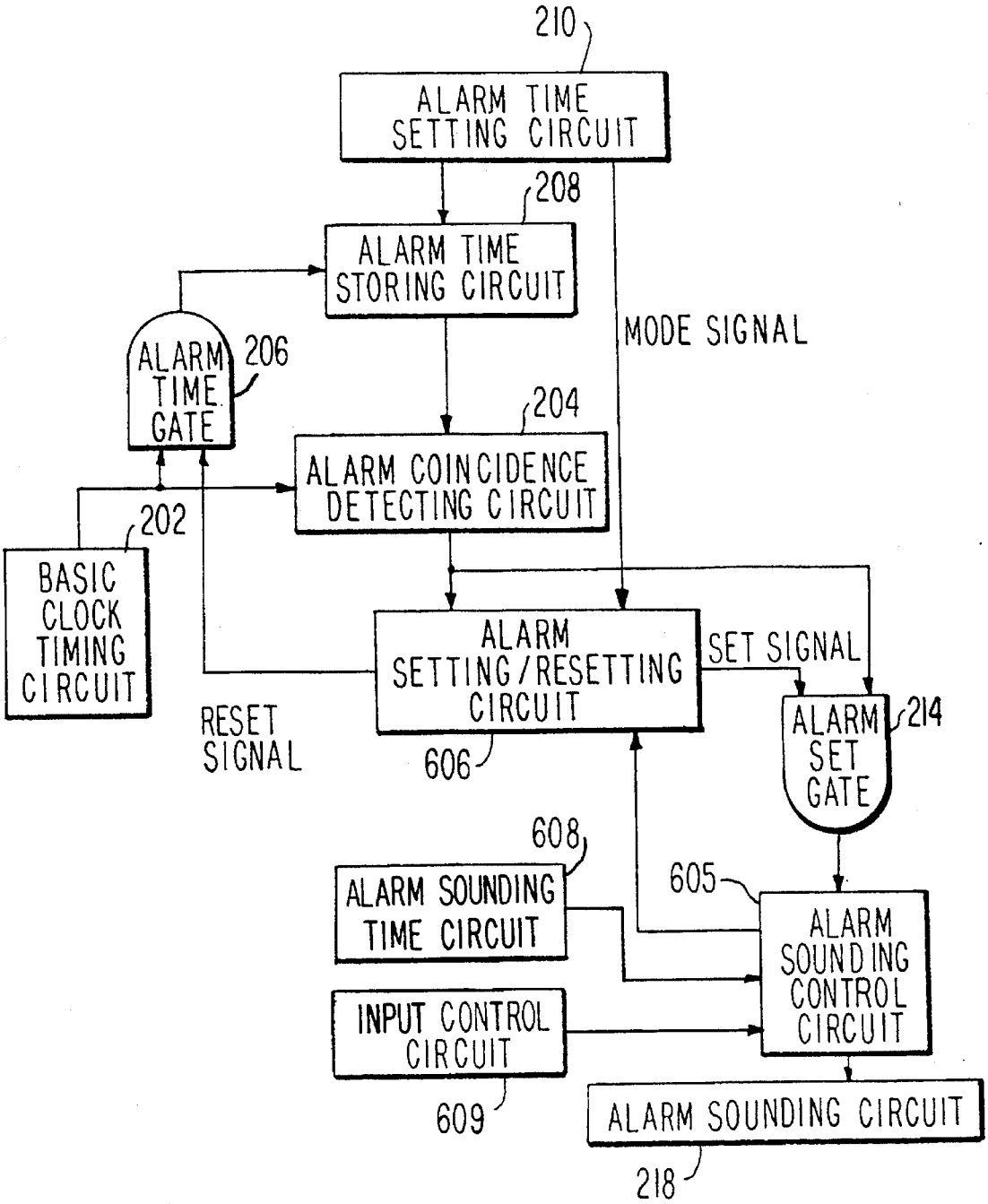
FIG. 6 is a block diagram of a second embodiment of the present invention.

In FIG. 6, the basic clock timing circuit 202, alarm time setting circuit 210, alarm time storing circuit 208, alarm coincidence detecting circuit 204, alarm sounding circuit 218, alarm time gate 206 and alarm sounding gate 214 are identical in function and design as in the first embodiment.

An alarm setting/resetting circuit 606 receives an input from an alarm sounding control circuit 605 as well as inputs from alarm time setting circuit 210 and alarm coincidence detecting circuit 204. Alarm setting/resetting circuit 606 provides its output to alarm sounding gate 214 and alarm time gate 206. Alarm sounding control circuit 605 also receives inputs from alarm sounding time counting circuit 608 and input control circuit 609 in addition to the output from the alarm sounding gate 214.

With an alarm setting/resetting circuit 606 in the set state, if alarm coincidence detecting circuit 204 issues the time coincidence detection signal, then alarm sounding gate 214 causes the alarm to be sounded. In this modified design, alarm sounding control circuit 605 controls the operation of alarm sounding circuit 218. Alarm sounding time counting circuit 608 can be a time counter for determining the length of time during which the alarm is enabled (sounded) while input control circuit 609 detects an input through an alarm sounding stop switch (switches 122) and issues a signal for shutting off the alarm in response to a switch input. Hence, alarm sounding control circuit 605 stops the sounding alarm when the length of time determined by alarm sounding time counting circuit 608 has passed or when input control circuit 609 detects that the alarm sounding stop switch has been triggered. As soon as the alarm stops sounding, alarm sounding control circuit 605 outputs a signal to alarm setting/resetting circuit 606 to reset alarm setting/resetting circuit 606.

The operation involved in the block diagram of FIG. 6 will now be explained in more detail with reference to the flowcharts in FIGS. 7 and 8.

Figure 7:
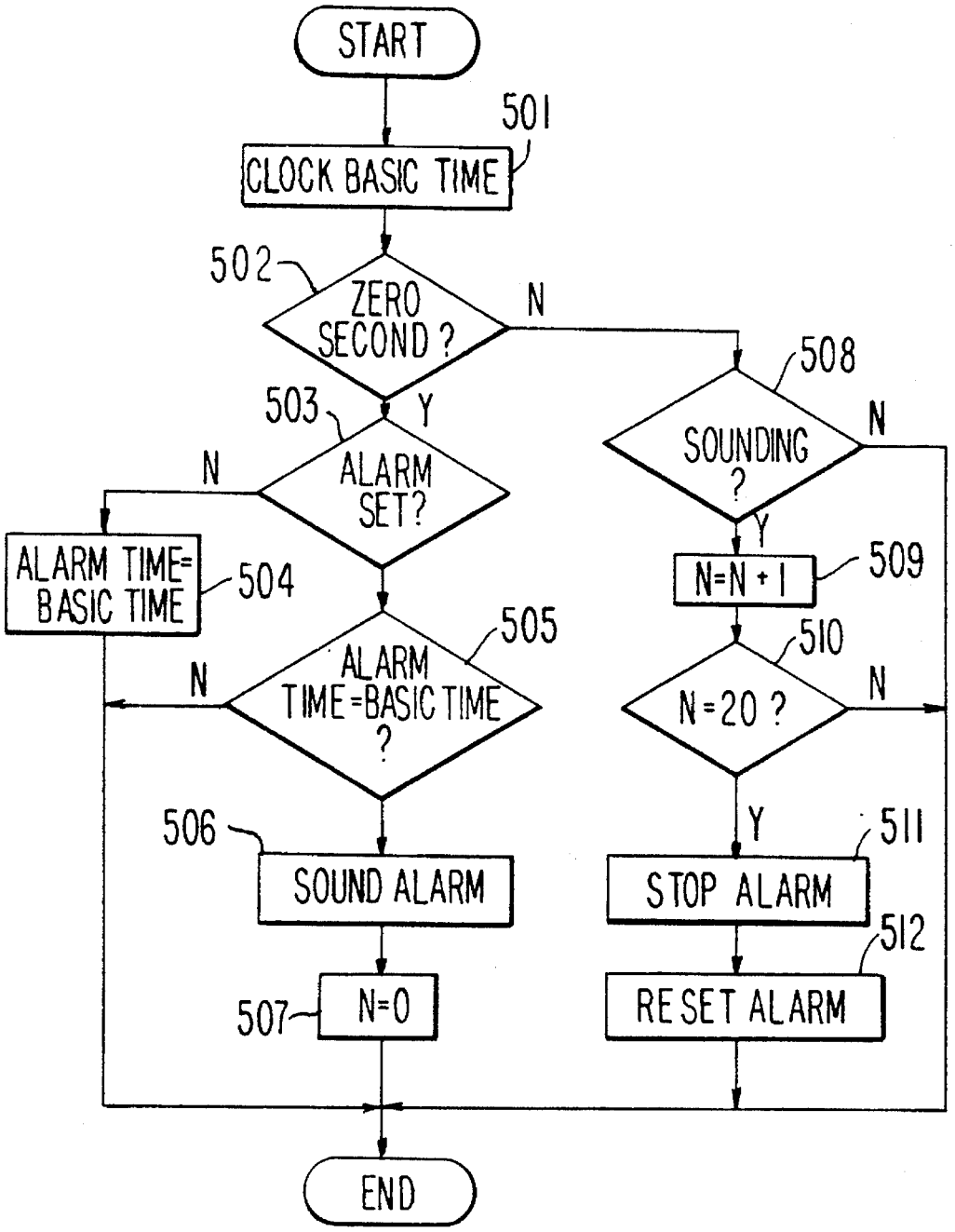
FIG. 7 is a flowchart for operation of an alarm sounding time counter in accordance with the second embodiment of the present invention.
Figure 8:
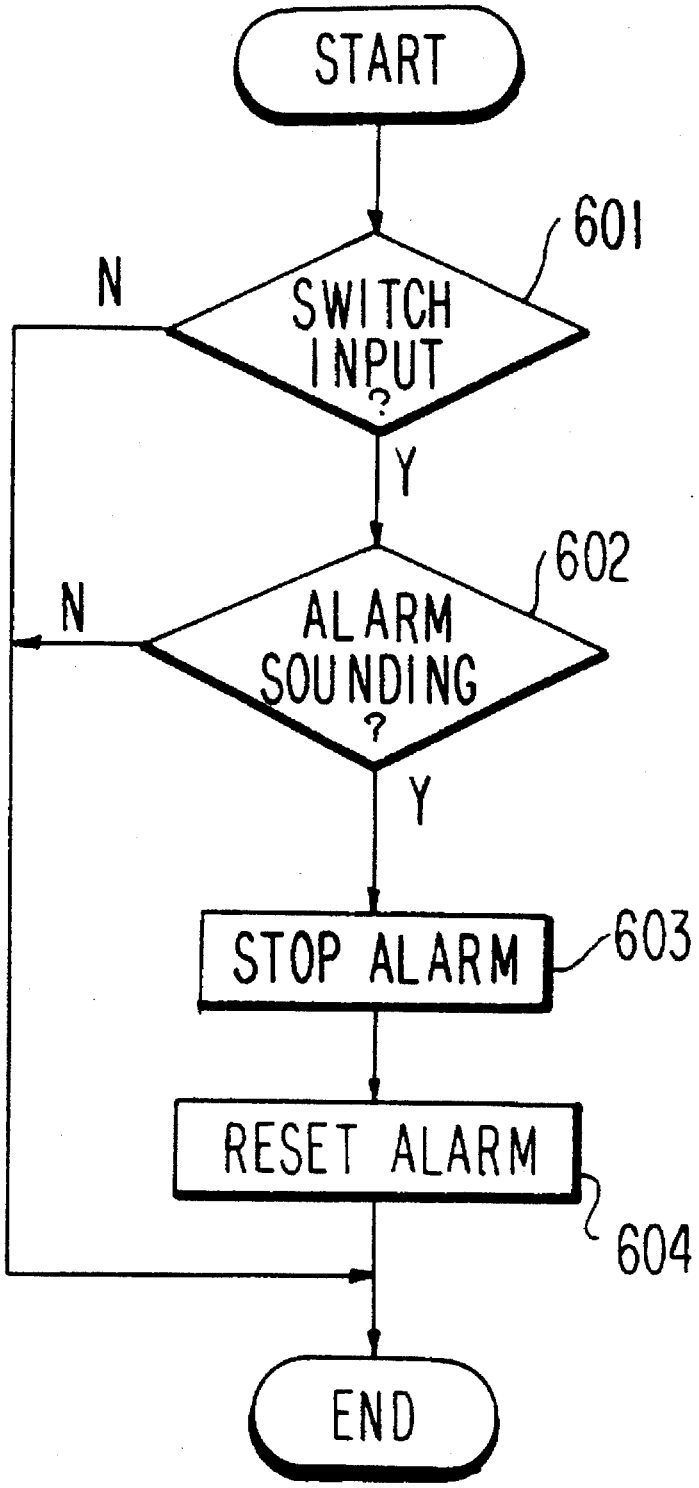
FIG. 8 is a flowchart for operation of an input control circuit in accordance with the second embodiment of the present invention.

FIG. 7 is a flowchart illustrating the operation of the alarm under the control of alarm sounding time counting circuit 608. As in the case of the program shown by the flowchart of FIG. 4, the flowchart in FIG. 7 also indicates the program which is actuated when the 1 Hz interrupt is received through interrupt control circuit 106 (FIG. 1). In other words, the program is executed every second. First, basic clock timing circuit 202 (FIG. 6) counts the basic time (step 501) and determines whether the basic time is zero second, that is, whether the minutes digit has been counted (step 502). At this time, if the basic time is found to be zero second, then it is further determined whether the alarm has been set (step 503) (i.e., whether alarm setting/resetting circuit 212 has been set). If the alarm is found to have been set, then the alarm time is checked for coincidence with the basic time (step 505); if coincidence is detected, then the alarm is sounded (step 506).

However, if it is found in step 503 that the alarm has not been set (i.e., alarm setting/resetting circuit 606 has been reset), then the basic time is stored in the alarm time memory 140 (FIG. 1) and the alarm time increases in synchronism with the basic time (step 504). The procedure up to step 504 is the same as that illustrated in FIG. 4.

If coincidence is detected (step 505), it has been determined that the alarm should be sounded (step 506). The program then sets a parameter N of the alarm sounding time count to 0 (step 507). N denotes the parameter for determining the alarm sounding time.

If it is determined in step 502 that the basic time is other than zero second and that the alarm is sounding (step 508), then parameter N of the alarm sounding time count is incremented (step 509). When it is determined that N has reached a predetermined value (e.g. 20) (step 510), the alarm sounding is stopped (step 511). A resetting signal is then sent to alarm setting/resetting circuit 606 (FIG. 6) to reset the alarm (step 512).

It is to be understood that the setting of the alarm sounding time to 20 seconds is by way of example. No special operation is required for setting the alarm sounding time to less than one minute since the alarm time coincides with the basic time when the alarm sounding stops. That is, the alarm sounding time may be set to any desired value with the exception that if the alarm sounding time is set to one minute or more, then the alarm time differs from the basic time, that is, the basic time will be the alarm time plus one minute. Therefore, the alarm is first reset in step 512. Then the basic time is copied into the alarm time memory 140 so that the alarm time follows the basic time. In other words, the same processing as that in step 504 is carried out.

The method of operation of FIG. 7 can be modified to provide a prolonged alarm sound. The following provides a description of two available modified methods.

In the first modified method, an extra step for determining whether the alarm is sounding is added between step 501 and step 502. If the alarm is not sounding, then the program proceeds to step 502 and if the basic time is other than zero second, then the program terminates the routine. If the alarm is sounding, then the program proceeds to step 509. In this case, the count value in step 510 is set to a value larger than 20 (e.g., 100 or 200).

In the second modified method, an extra step for determining whether the alarm is sounding is added between step 502 and step 503. If it is found in step 502 that the basic time is other than zero second, then the routine is terminated. If it is determined that the alarm is not sounding, then the program goes to step 503. If the alarm is sounding, then the program initiates the routine from step 509 to step 512. In this case, the alarm sounding time is set on a basis of one minute. Therefore, when the count value is set to 5 in step 510, the alarm sounds for 5 minutes.

The following describes an example where the alarm sounding is stopped by pressing a switch rather than by setting the alarm sounding time. FIG. 8 shows the flowchart for illustrating the operation of the alarm under the control of input control circuit 609.

First, it is determined whether an input has been provided. This input can be entered via a switch 122 (step 601). If an input is detected,, then it is determined whether the alarm is sounding (step 602). If the alarm is sounding, the alarm is stopped (step 603) and the alarm is reset by changing the mode of alarm setting/resetting circuit 606 (step 604). As in the operation illustrated in FIG. 7, no special operation is required if the alarm sounding time is shorter than one minute since the alarm time coincides with the basic clock time when the alarm stops sounding. If the alarm sounding time is one minute or longer, then the basic time is copied in the alarm time memory 140 after step 604 so as to implement the processing for adopting the alarm time as the basic time.

First external control switch 156 or second external control switch 158 (FIG. 2) can be us as the input switch. These switches are intended to be used for the setting of the alarm time, although they can be used to stop the sounding alarm since there is no need to set the alarm time while the alarm is sounding. Either or both switches 156 and 158 may be used to stop the sounding alarm. In addition, a separate switch may be provided as the input switch to stop the sounding alarm.

Another modification of the first embodiment will now be briefly described. The modification relates to the selection of whether the alarm setting/resetting circuit should be reset after the alarm is sounded.

As shown in FIG. 3, alarm setting/resetting circuit 212 is switched to the reset state after the alarm is sounded. This prevents the alarm from being actuated unless a new alarm time is set. The alarm time automatically follows the basic time. Accordingly, the first embodiment can be referred to as the "one-time alarm" embodiment.

Alternatively, alarm setting/resetting circuit 212 may not be switched to the reset state after the alarm is sounded. In this situation, since alarm setting/resetting circuit 212 will remain in the set state, the alarm time does not follow the basic time. Instead, the alarm time remains as the previously set alarm time. Thus, the alarm sounds again when a predetermined time elapses, providing an embodiment that could be termed the "repeatable alarm" embodiment.

This modification is designed to provide a user with a selection between the "one-time alarm" embodiment and the "repeatable alarm" embodiment. The following presents a description of the construction to provide for either a "one-time alarm" or "repeatable alarm".

In FIG. 3, a selecting circuit can be added to select whether alarm setting/resetting circuit 212 should be reset. The output of the selecting circuit controls the resetting of alarm setting/resetting circuit 212. The selecting circuit is controlled by the input of an external control switch (not shown) so as to enable the user to select whether alarm setting/resetting circuit 212 should be reset. First external control switch 156 or second external control switch 158 may be used as the external control switch for making the selection. Similarly, a separate switch from switch group 122 may be provided as the external control switch.

A series of these control steps can be implemented by software. For example, and as shown in FIG. 7, the alarm resetting in step 512 can be changed. Instead of always resetting the alarm, a software routine for determining whether the alarm is to be reset or not can be added so that the alarm is not reset when an input is provided through an external control switch or the like, and the alarm is reset when no input is given through the switch.

This structure enables two different types of alarm settings in accordance with the desire of the user. Further, different modes of alarm sounding may be provided for the "one-time alarm" embodiment and the "repeatable alarm" embodiment. More specifically, the sounding pattern, which may include an alarm sounding interval, an alarm sounding length and/or an alarm sound frequency, or the like, is changed. The differences in alarm sound make it easier to distinguish between the one-time alarm and the repeatable alarm.

Figure 9:
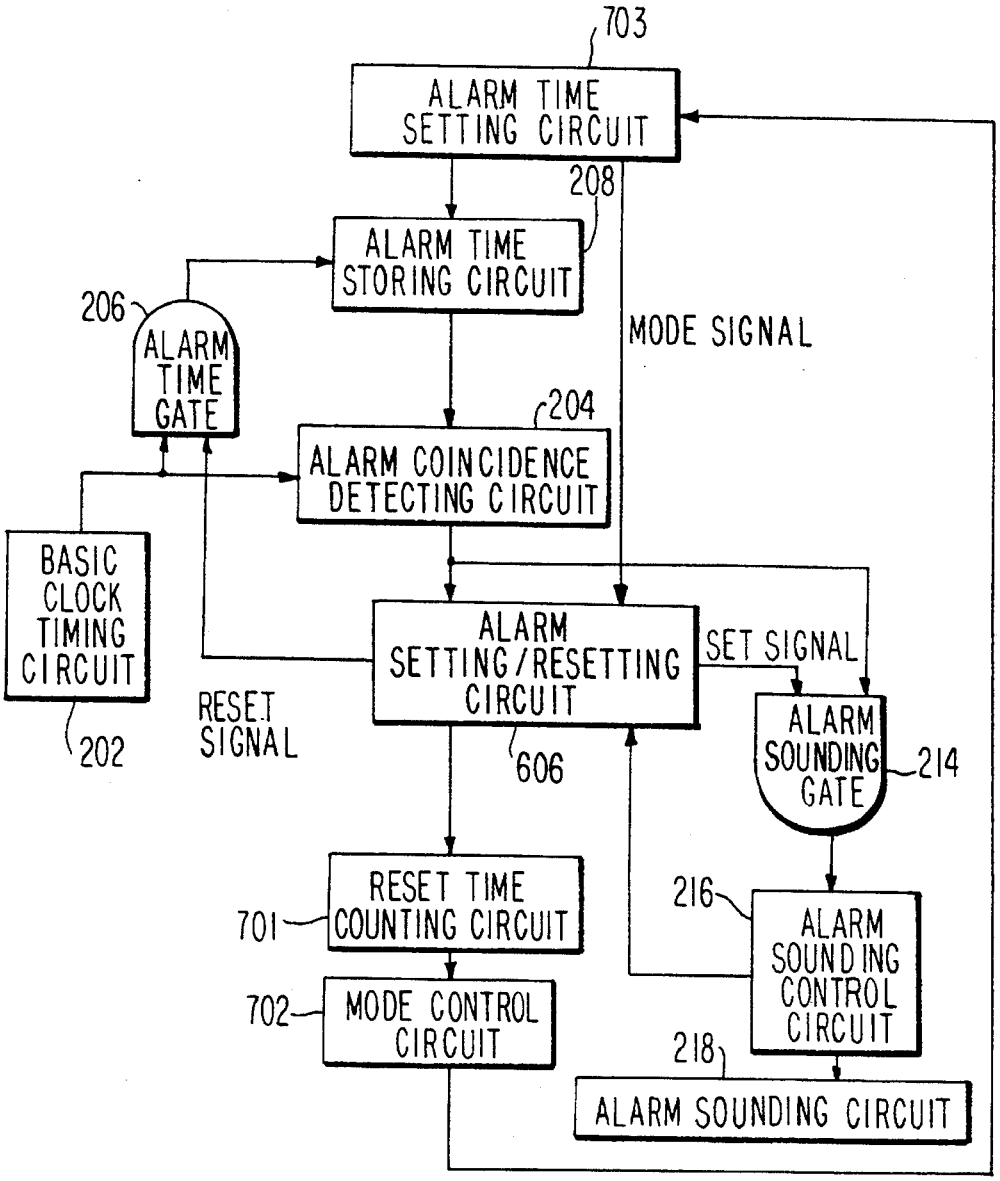
FIG. 9 is a block diagram of an electronic alarm clock constructed in accordance with a third embodiment of the present invention.
Figure 10:
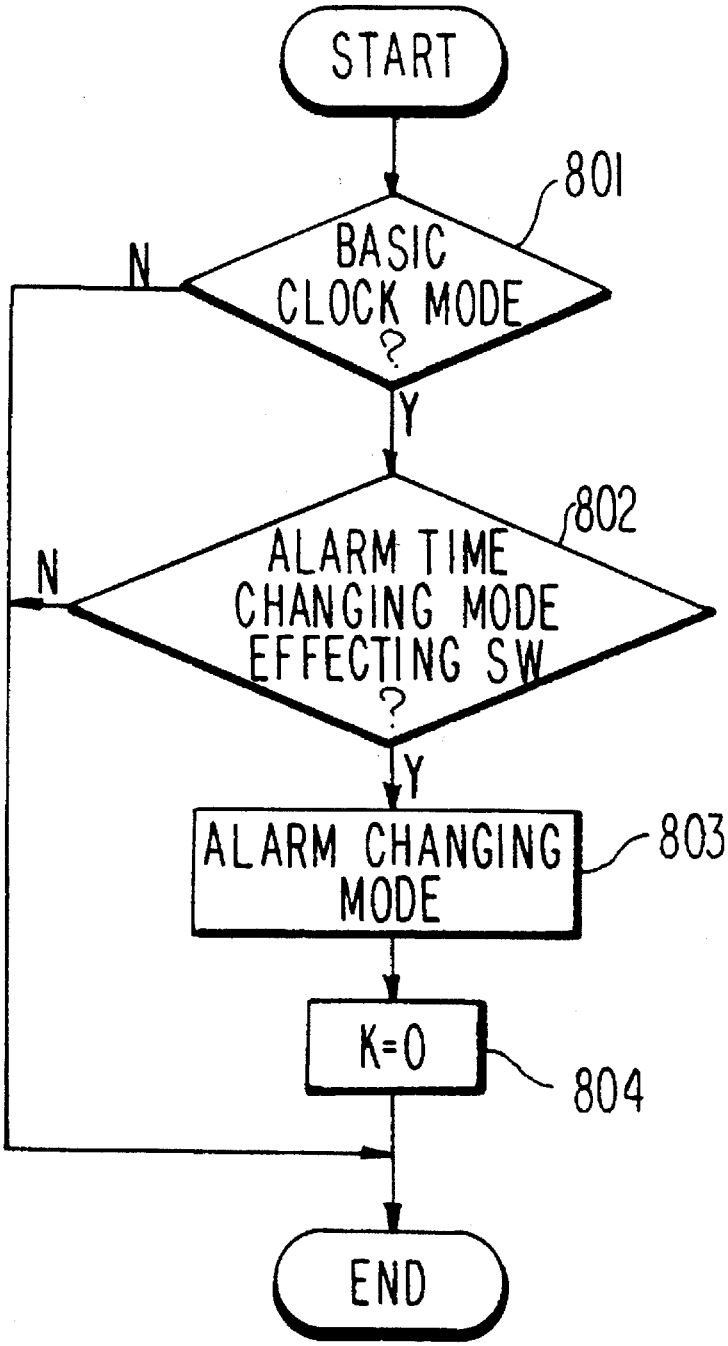
FIG. 10 is a flowchart of the operation for changing from a basic clock mode to an alarm time setting mode in accordance with the third embodiment of the present invention.
Figure 11:
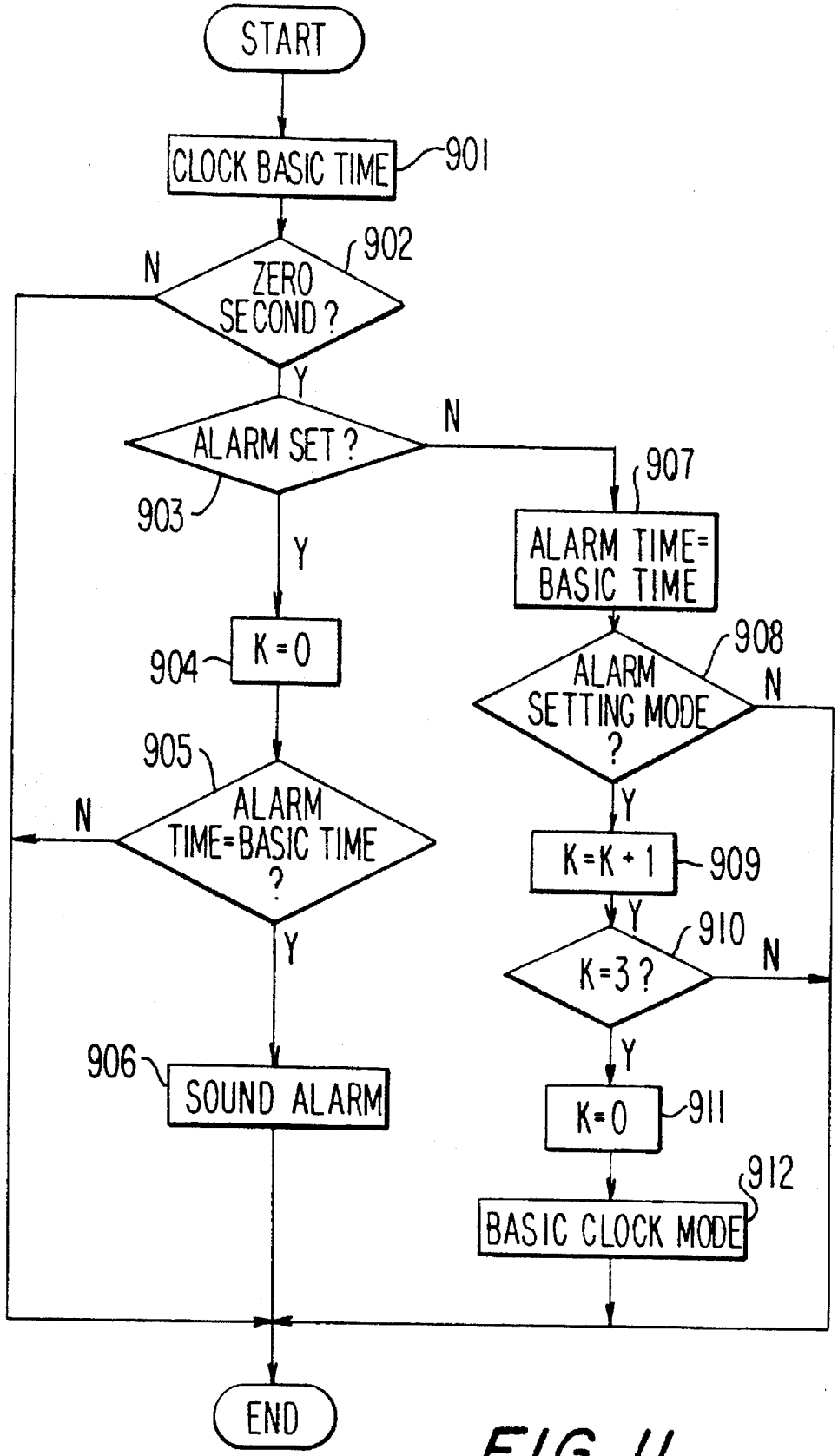
FIG. 11 is a flowchart of the operation for changing from the alarm time setting mode to the basic clock mode in accordance with the third embodiment of the present invention.

Reference is now made to FIGS. 9–11 which illustrate the electronic clock with alarm in accordance with a third embodiment of the present invention. The third embodiment discloses the operation in the alarm time setting mode. Like numerals are used to indicate like structures, the primary difference being that the time during which the alarm setting/resetting circuit is reset is measured to control the operation in the alarm time setting mode.

In this embodiment, a reset time counting circuit 701 is added and receives an output from the alarm setting/resetting circuit 606. A mode control circuit 702 receives the output from reset time counting circuit 701 and provides an input to alarm time setting circuit 703. Alarm time setting circuit 703 provides the inputs for alarm time storing circuit 208 and alarm setting/resetting circuit 606.

Alarm time setting circuit 703 can be designed to carry out two steps of operation; in the first step, the basic clock mode (the second mode) is switched to the alarm time setting mode (the first mode), and in the second step, the alarm time is set. If alarm setting/resetting circuit 606 is in the reset state, then a reset duration is measured by a reset period counting circuit 701. When reset period counting circuit 701 reaches a predetermined value, a mode control circuit 702 sends a command to alarm time setting circuit 703 to switch the electronic clock from the alarm time setting mode to the basic clock mode. This prevents the alarm time from being set through alarm time setting circuit 703.

The operation will be described in more detail with particular reference to FIGS. 10 and 11.

FIG. 10 is a flowchart illustrating the operation of switching from the basic clock mode to the alarm time setting mode. It is assumed that the electronic clock is currently in the basic clock mode, and the basic clock mode will be changed to the alarm time setting mode by the setting of a switch. Preferably, first external control switch 156 or second external control switch 158 is used as the aforementioned switch, although a separate switch may be added therefor.

It is determined whether the clock is in the basic clock mode (step 801). When in the basic mode, it is determined whether an input has been given through the alarm time setting mode switch (step 802). If the input has been detected, the mode of the electronic clock is replaced by the alarm time setting mode (step 803), and parameter k for measuring the time during which the alarm clock is in the reset mode is reset to zero (step 804). At this time, however, the state of the alarm setting/resetting circuit 606 remains unchanged. Hence, pressing the alarm setting mode switch just once does not bring up the alarm setting mark 159 and does not change the alarm time. More specifically, if the alarm time has not been set, then the alarm time remains the same as the basic time; if the alarm time has been set, then the set alarm time is displayed.

Because of the two-step operation of alarm time setting circuit 703, pressing the switch again under such a condition causes the alarm setting mark 159 to be displayed and the alarm time to be changed. If first external control switch 156 is pressed, then the alarm time is incremented by one minute; if second external operating switch 158 is pressed, then the alarm time is decremented by one minute and the alarm setting/resetting circuit 606 is set. In other words, pressing the switch twice enables the setting of the alarm time.

Reference is now made to FIG. 11 which shows the operation involved in the switching from the alarm time setting mode to the basic clock mode. The program based on the flowchart shown in FIG. 11 is activated when the 1 Hz interrupt is received through the interrupt control circuit 106 shown in FIG. 1.

First, the basic time is counted (step 901) and then checked to determine whether the basic time is zero second (i.e., whether the minute-digit count has occurred) (step 902). If the basic time is found to be other than zero second, then the program is terminated without any further operation. If the basic time is found to the zero second, then it is determined whether the electronic clock is in the alarm set state (step 903). The alarm set state refers to a state wherein the alarm setting/resetting circuit 606 has been set. If the alarm set state is detected, then k of reset time counting circuit 701 is reset to zero (step 904) and the alarm time is checked for coincidence with the basic time (step 905). If the coincidence is detected, the alarm is sounded (step 906).

If it is determined in step 903 that the alarm is not in the set state (i.e., the alarm is in the reset state), then the basic time is copied into the alarm time memory and the alarm time is adopted as the basic time (step 907). Accordingly, in the alarm reset state, the alarm time becomes the same as the basic time and it is incremented as the basic time is incremented. Further, if the electronic clock is in the alarm time set mode (step 908), then k is incremented by 1 (step 909); if k is 3 (a predetermined count value), then k is reset to zero (step 910), and the alarm time setting mode is switched to the basic clock mode (step 912).

Therefore, simply changing to the alarm time setting mode causes the alarm reset state to be maintained. If no switch is pressed under this condition, then the mode is automatically switched back to the basic clock mode in 2 to 3 minutes. Pressing the alarm time setting mode switch just once will not set the alarm and the basic clock mode is restored in a predetermined time. This feature prevents an unwanted alarm from sounding even if the switch is pressed by mistake.

In addition, there is an alternative method in which the alarm time setting mode switch can be operated. According to the method described above, the setting of the alarm time is enabled by the pressing of a switch twice, intermittently. The setting of the alarm time can be set by pressing the switch once in accordance with the method which will be described below.

The moment the alarm time setting mode switch is pressed, the alarm time setting mode is effected. At this time, alarm setting/resetting circuit 212 is still in its previous state and therefore the alarm is not sounded immediately. Thus, the state set by the operation of the switch is maintained. When the state continues for a predetermined time (e.g., about 2 seconds), the alarm time is incremented or decremented depending on which switch has been pressed and the alarm is set. This means that the alarm time can now be set. Pressing the switch once allows the alarm time to be set. Usually, if a user accidentally press on the switch, the pressing usually lasts only for a short time of one second or less, and therefore, this alternative method ensures reliability from accidentally pressing on the switch.

In accordance with the third embodiment of the invention, although the basic clock mode is taken as an example of the second mode wherein no alarm time can be set, the second mode is not restricted thereto. It may be another mode including, for example, the setting mode of the basic clock time (e.g., the setting of time-zone differences or summer time), an environmental data measuring mode (temperature, humidity, atmospheric pressure, wind velocity, water pressure, azimuth, acceleration or kinetic state, the amount of ultraviolet rays, the amount of radioactive rays, illuminance, the intensity of electric field, the intensity of magnetic field, the detection of gas, etc.), a diving mode (a mode for handling the information related to a diving operation which may include the depth of water, diving time, possible diving time/depth, and the volume of remaining air), a data analysis mode (a mode for selecting, converting, computing, displaying and storing gathered data), and a communication mode (a mode for exchanging data with separate equipment from the main body of the electronic clock).

Figure 12:
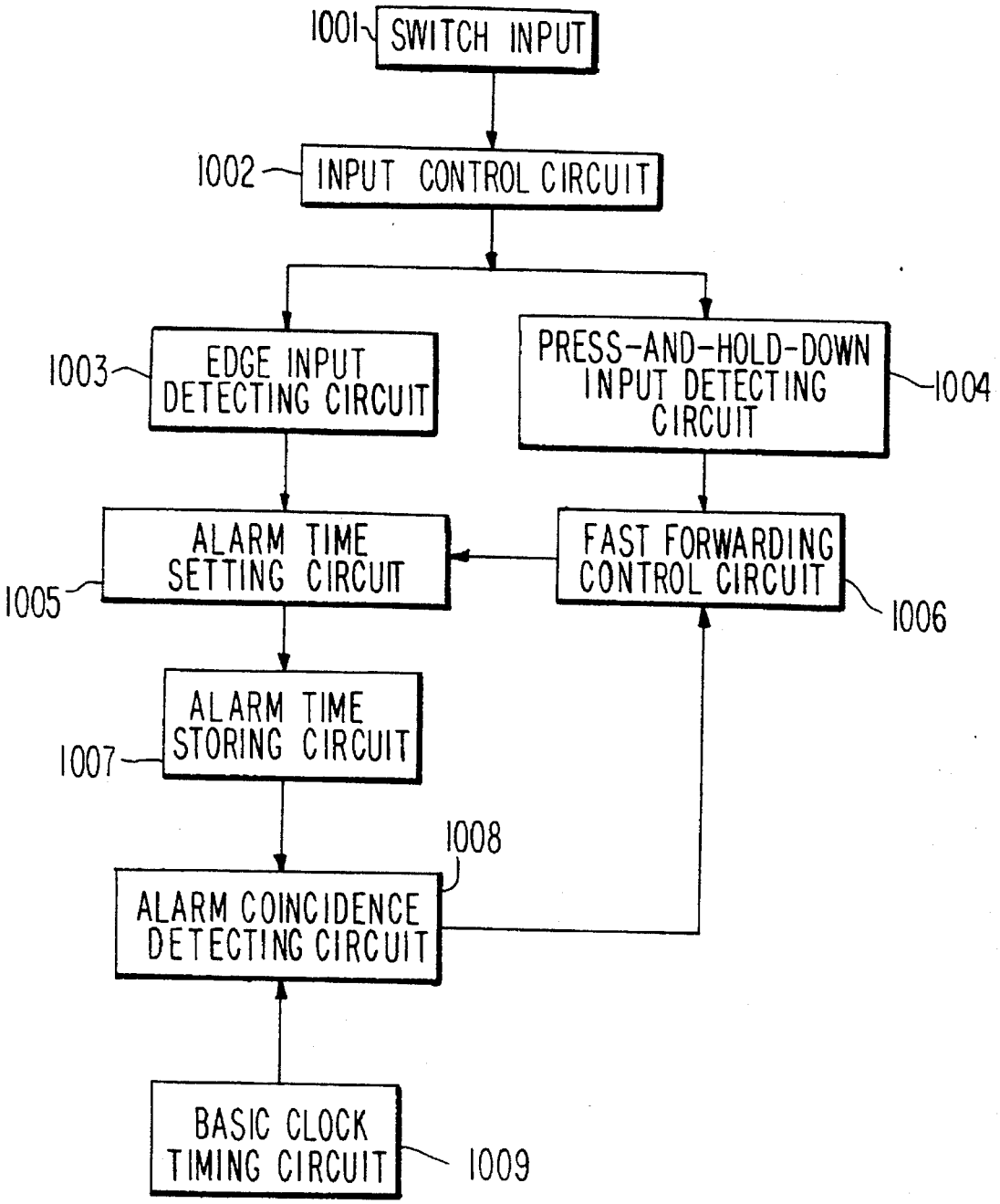
FIG. 12 is a block diagram of an electronic alarm clock constructed in accordance with a fourth embodiment of the present invention.
Figure 13:
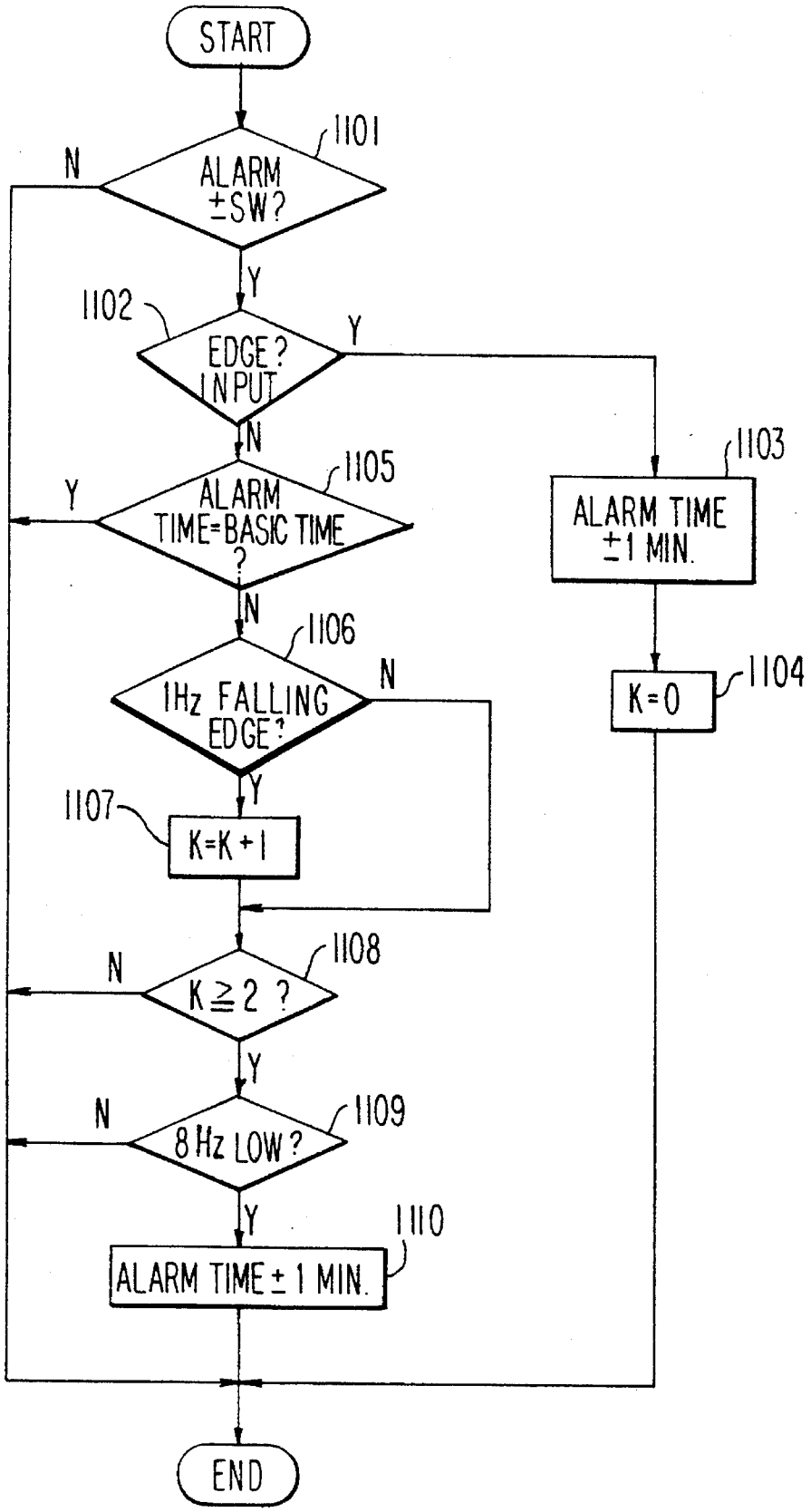
FIG. 13 is a flowchart of the operation of an electronic alarm clock in accordance with the fourth embodiment of the present invention.
Figure 14:
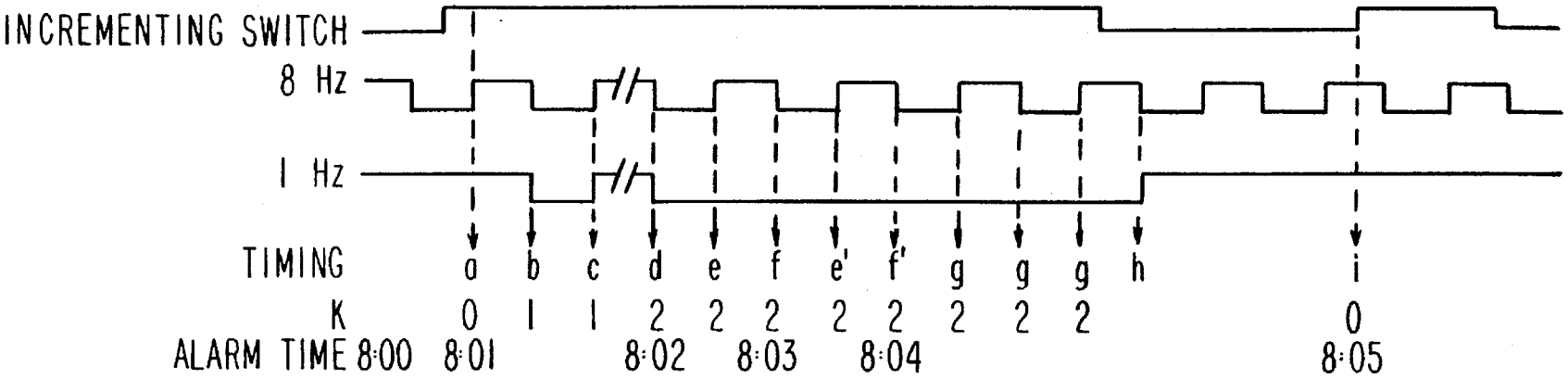
FIG. 14 is a timing chart illustrating the operation of an electronic alarm clock in accordance with the fourth embodiment of the present invention.

Reference is now made to FIGS. 12–14 which describe the electronic clock with alarm in accordance with a fourth embodiment of the present invention. The fourth embodiment is characterized by its alarm time setting method in the alarm time setting mode. More particularly, the fourth embodiment relates to the control method for the control circuit for fast forwarding the time.

A switch 1001 provides an input to an input control circuit 1002. Input control circuit 1002 provides inputs to an edge input detecting circuit 1003 and a press-and-hold-down input detecting circuit 1004. A fast forwarding control circuit 1006 receives the input from press-and-hold-down input detecting circuit 1004 and an alarm coincidence detecting circuit 1008 and outputs a signal to alarm time setting circuit 1005 which also receives an input from edge input detecting circuit 1003. Alarm time setting circuit 1005 also provides an output to alarm time storing circuit 1007. Alarm coincidence detecting circuit 1008 provides an output to fast forwarding control circuit 1006 in response to inputs from alarm time storing circuit 1007 and a basic clock timing circuit 1009.

Input control circuit 1002 detects whether switch 1001 has been set (i.e., whether an input has been provided through the switch). For this purpose, first external control switch 156, second external control switch 158, or the like may be suitably used.

The detected switch input is checked through an edge input detecting circuit 1003 to determine whether it is an edge input and also checked through a press-and-hold-down input detecting circuit 1004 to determine whether the input is a press-and hold-down input. If the detected switch input is an edge input, then the alarm time stored in an alarm time storing circuit 1007 is incremented by one minute or decremented by one minute (this is referred to as adding or subtracting by the unit amount) via an alarm time setting circuit 1005 which is connected to the edge input detecting circuit 1003. Whether the alarm time is incremented or decremented depends on which switch is pressed. The unit amount for the increment or decrement is not restricted to one minute; it is possible to adopt an arbitrary value such as 10 seconds, 2 minutes, 5 minutes, 10 minutes, 1 hour, or the like.

If press-and-hold-down input detecting circuit 1004 detects that the detected input is a press-and-hold-down input, then the alarm time stored in the alarm time storing circuit 1007 is subjected to fast-forward increment or decrement via a fast forward control circuit 1006 which is connected to the press-and- hold-down input detecting circuit 1004. An alarm coincidence detecting circuit 1008 connected to alarm time storing circuit 1007 compares the alarm time with the content (i.e. the basic time) of a basic time counting circuit 1009 and if it finds that the alarm time and basic time coincide with each other, then alarm coincidence detecting circuit 1008 stops the operation of the fast forwarding control circuit 1006 so as to stop the changing of the alarm time.

The operation involved in the block diagram stated above will now be discussed with particular reference to FIG. 13. For the fast processing of the alarm time, when a switch input that is a press-down-and-hold input lasts for 1 to 2 seconds, the alarm time is incremented or decremented by 1 minute at a frequency of 8 Hz thereafter. In other words, the fast forwarding period starts 1 to 2 seconds after the switch is pressed and held down, and after that, the alarm time is incremented or decremented on the 1-minute basis once very ⅛ second. Therefore, the alarm time is incremented or decremented by 8 minutes each second. For this reason, the program must be repeatedly actuated once every ⅛ second or less. In this embodiment, the program is actuated at a frequency of 16 Hz. The time required for the fast forwarding period to start following the detection of the switch input varies within the range of 1 to 2 seconds because of the variations in the timing at which the switch is pressed.

When the input through the switch for incrementing the alarm time or the switch for decrementing the alarm time is detected (step 1101), it is first determined whether the input is an edge input (step 1102). If the input is an edge input, then one minute is added or subtracted to the alarm time unconditionally in accordance with the switch through which the input was made (step 1003) and counter value K for the fast forwarding processing is reset to zero (step 1104). This means that one minute is added or subtracted as soon as the switch is pressed.

If the switch input turns out to be a non-edge input, then it is by default a press-and-hold-down input and the alarm time is compared with the basic clock time (step 1105). If the alarm time does not coincide with the basic clock time, then the fast forwarding control of steps 1106 to 1109 are performed. It is first determined whether the timing is on a falling edge of the 1 Hz signal (step 1106). If it is on a falling edge, then counter value K is incremented by 1 (step 1107). If it is not, then it is further determined whether counter value K is 2 or more (step 1108). If counter value K is less than 2, then the program is immediately terminated; if it is 2 or more, then it is further determined whether an 8 Hz signal is a logic low or not, and, if it turns out to be a logic low, then the alarm time is incremented or decremented by 1 minute (step 1110).

Reference is now made to the timing chart of FIG. 14 for an example of the above-mentioned operation and method. It is assumed that the basic clock time is currently 8:04 and the alarm time is 8:00. When the incrementing switch is pressed (timing a), the switch input is detected (step 1101) and it is determined whether the detected switch input is an edge input (step 1102). Since it can be seen that the switch input is an edge input, the alarm time is incremented by 1 minute (step 1103) to be 8:01. Counter value K is reset (step 1104) to zero (K=0).

At the next program actuating timing b, the switch input is detected (step 1101) and it is determined whether the detected switch input is an edge input (step 1102). Since there is no edge input at timing b, then it is further determined whether the alarm time coincides with the basic clock time (step 1105). At this moment in this example, the alarm time is 8:01 and the basic time is 8:04. The alarm time and basic time do not coincide, and therefore, the program next determines whether the 1 Hz signal is on a falling edge (step 1106). At moment b, it can be seen that the 1 Hz signal is on the falling edge, and therefore, counter value K is incremented by 1 (step 1107). Then it is further determined whether value K is 2 or more (step 1108). In this example, counter value K is 1 so the program is terminated.

At actuating timing c, the switch input is detected (step 1101) and it is determined whether the detected switch input is an edge input (step 1102). Since no edge input is detected, it is then determined whether the alarm time coincides with the basic clock time (step 1105). At this time, the alarm time is still 8:01 and the basic time is 8:04. Since these numbers still do not coincide, the program checks for the falling edge of the 1 Hz signal (step 1106). It can be seen that the 1 Hz signal is at a rising edge and therefore, counter value K remains unchanged. Step 1108 is then performed to determine whether the value K is 2 or more. Since counter value K is 1 (i.e., less than 2), the program is terminated. Hence, both the alarm time and the counter value remain unchanged.

After repeating the same operation as that implemented at timing c, at the following program actuation timing d, the switch input is detected (step 1101) and it is determined whether the detected switch input is the edge input (step 1102). Since it is not an edge input, it is then determined whether the alarm time coincides with the basic clock time (step 1105). The alarm time is still 8:01 and the basic clock time is 8:04. Therefore, the alarm time and the basic time do not coincide. Therefore, the program checks for the falling edge of the 1 Hz signal (step 1106). Since the 1 Hz signal falling edge is detected, counter value K is incremented by 1 (step 1107). It is then determined whether value K is 2 or more (step 1108). Since counter K is 2, it is next determined whether the 8 Hz signal is a logic low (step 1109). In this case, the 8 Hz signal is a logic low and therefore the alarm time is incremented by one minute (step 1110) to be 8:02 before the program is terminated.

At the next program actuating timing e, the above mentioned program is initiated and steps 1101, 1102, 1105, 1106 and 1108 are logically determined. Following the above steps, one will logically reach step 1109 where it will be determined if the 8 Hz signal is a logic low. It can be seen that the 8 Hz signal is not a logic low and therefore, the program is immediately terminated.

Similarly, at program actuating timing f, it can be readily determined following the above steps that step 1109 is again reached and it will therefore be determined based on the example given in FIG. 14, that the 8 Hz signal is at a logic low. Therefore, the alarm time is incremented by one minute (step 1110) to be 8:03 before the program is terminated.

At program actuating timing e', the same operation as that implemented at program actuating timing e is carried out. At program actuating timing f', the same operation as that carried out at program actuation timing f causes the alarm time to be identical to the basic clock time 8:04. Then, at the next program actuation timing g, the switch input is detected (step 1101) and it is determined whether the detected switch input is an edge input (step 1102). Since there is no edge input, it is further determined whether the alarm time coincides with the basic clock time (step 1105). The alarm time is 8:04 and the basic clock time is also 8:04. Since these two times coincide with each other, the program is immediately terminated. Thereafter, the operation carried out at the program actuation timing g is repeated as long as the incrementing switch is pressed. Therefore, it can be seen that the alarm time remains unchanged even if the pressing of the switch is continued. If, however, the basic time advances one minute in the middle, then the basic time no longer coincides with the alarm time. For this reason, the same operation as that carried out at program actuating timing d is implemented and the alarm time is incremented by one minute. Hence, the alarm time follows the basic time.

If the incrementing switch is released under the aforesaid condition wherein both basic time and alarm time are 8:04, then the release of the incrementing switch is detected at program actuating timing h. If the incrementing switch is thereafter pressed again, then the same operation as that carried out at the program actuating timing a is performed at program actuating timing i; the switch input is detected (step 1101) and it is determined whether the detected switch input is the edge input (step 1102). Then the alarm time is incremented by one minute (step 1103) to be 8:05. Counter value K is reset (step 1104) to zero. After that, the same operations as those implemented at the program actuation timings b, c, d, e, f and g are performed.

with such an arrangement, the alarm time always stops at the current time even if it is fast forwarded. Thus, when setting an alarm time which is relatively close to the current time, the current time can be utilized as the reference time, making it extremely easy to set the alarm time. This feature is especially useful for repeatedly setting the alarm time.

In this embodiment, the fast forwarding is performed when count value K becomes 2 or more; however, the value should not be considered to be restricted thereto. For the easiest operation for the user, K should be $1<K<3$ for the fast forwarding operation. Likewise, although the 8 Hz signal for adding or subtracting 8 units in one second is employed for the fast forwarding, the frequency should preferably range from about 4 Hz to about 64 Hz.

Further, the fourth embodiment may be combined with the first embodiment. This permits easier resetting of the alarm setting/resetting circuit shown in the first embodiment because the alarm setting/resetting circuit is reset by making the alarm time coincide with the current time in the alarm time setting mode. This feature is conveniently used for preventing the alarm from sounding.

In addition, in the embodiments stated above, the various circuits which perform the various operations, such as basic clock timing circuit 101, alarm time setting circuit 102, alarm time storing circuit 103, alarm coincidence detecting circuit 104 and alarm setting/resetting circuit 106 are implemented by software programs. However, it is apparent that implementing the aforesaid circuit by hardware will provide the same desired results.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electronic clock with an alarm, comprising:

a clock timing circuit counting a basic time;

an alarm time setting circuit operable to set an alarm time;

an alarm time storing circuit, operatively coupled to said alarm time setting circuit, storing said alarm time;

an alarm coincidence detecting circuit operatively coupled to said clock timing circuit and said alarm time storing circuit, detecting the coincidence between said basic time and the alarm time stored in said alarm timing storing circuit;

an alarm sounding circuit;

an alarm setting/resetting circuit, operatively coupled to said alarm time setting circuit, said alarm coincidence detecting circuit to be in a set state when said alarm coincidence detecting circuit detects that said basic time and said alarm time do not coincide with each other, and to be in a reset state when said alarm coincidence detecting circuit detects coincidence between said basic time and said alarm time, said alarm time setting circuit is in operation, and said alarm sounding circuit is actuated after setting, to store said basic time in said alarm time storing circuit;

an alarm sounding control circuit, operatively coupled to said alarm setting/resetting circuit and alarm sounding circuit, actuating said alarm sounding circuit to sound said alarm after said alarm setting/resetting circuit is set and said alarm coincidence detecting circuit detects the coincidence between said basic time and said alarm time.

2. The electronic clock with alarm as claimed in claim 1, further comprising an alarm sounding time counting circuit, operatively coupled to said alarm sounding control circuit to discontinue the operating of said alarm sounding circuit, and an input control circuit operatively coupled to said alarm sounding time counting circuit to control the length of time during which the alarm is sounded.

3. The electronic clock with alarms claimed in claim 1, further comprising a selecting circuit selecting whether said alarm setting/resetting circuit is to be reset when a sounding alarm is stopped.

4. The electronic clock with alarm as claimed in claim 1, further comprising a reset time counting circuit operatively coupled to said alarm setting/resetting circuit and counting the duration in which said alarm setting-resetting circuit is in a reset state, and a mode control circuit operatively coupled to said reset time counting circuit to prevent the alarm time from being changed when the value of said reset time counting circuit reaches a predetermined value.

5. The electronic clock with alarm as claimed in claim 1, wherein said alarm time setting circuit includes a switch input for activation thereof.

6. An electronic clock with an alarm, comprising:

a switch producing an edge input when first actuated and a press-and-hold-down input when said switch is held down;

an input control circuit operatively coupled to said switch and detecting a switch input;

an edge input detecting circuit operatively coupled to said switch and said input control circuit to detect whether the switch input detected by said input control circuit is an edge input;

a press-and-hold-down input detecting circuit operatively coupled to said switch and input control circuit to detect whether the switch input detected by said input control circuit is a press-and-hold-down input;

an alarm time setting circuit operatively coupled to said edge input detecting circuit, and incrementing or decrementing the alarm time by one unit when said edge input detecting circuit detects the edge input;

a fast forwarding control circuit operatively coupled to said press-and-hold-down input detecting circuit and said alarm time setting circuit, to fast forward the alarm time by operating said alarm setting circuit for a press-and-hold-down input time while said press-and-hold-down input detecting circuit is detecting a press-and-hold-down input;

an alarm time storing circuit, operatively coupled to said alarm time setting circuit, and storing an alarm time; and an alarm coincidence detecting circuit, operatively coupled to said alarm time storing circuit, and providing an output to said fast forwarding control circuit to stop said fast forwarding control circuit when it is detected that the alarm time stored in said alarm time storing circuit coincides with a basic time.

7. The electronic clock with alarm as claimed in claim 6, further comprising a basic clock timing circuit counting basic time and outputting said basic time to said alarm coincidence detecting circuit.

8. An electronic clock with alarm, comprising:

a clock timing circuit counting a basic time;

an input for inputting a selected alarm time;

an alarm time storing circuit, operatively coupled to said input, and storing one of said selected alarm time and said basic time as said alarm time;

a coincidence detecting circuit, operatively coupled to said clock timing circuit and alarm storing circuit, and detecting a coincidence between the alarm time and basic time;

an alarm, operatively coupled to said coincidence detecting circuit, and sounding when coincidence between said alarm time and said basic time is detected and said basic time is not stored as said alarm time;

said alarm not sounding when said basic time is stored as said alarm time and coincidence between the alarm time and said basic time is detected; and said basic time is continuously stored as said alarm time after said alarm is sounded and when said alarm is not sounded.

9. The electronic clock with alarm as claimed in claim 8, further including a selecting circuit for selecting whether said basic time is continuously stored as said alarm time after said alarm is sounded.

10. An electronic clock with an alarm, comprising:

a clock timing circuit counting a basic time;

a switch producing an edge input when first actuated and a press-and-hold-down input when said switch is held down;

an input control circuit operatively coupled to said switch and detecting said switch input;

an edge input detecting circuit operatively coupled to said switch and said input control circuit to detect whether the switch input detected by said input control circuit is an edge input;

a press-and-hold-down input detecting circuit operatively coupled to said switch and input control circuit to detect whether the switch input detected by said input control circuit is a press-and-hold-down input;

an alarm time setting circuit operatively coupled to said edge input detecting circuit, and incrementing or decrementing the alarm time by one unit when said edge input detecting circuit detects the edge input;

an alarm time storing circuit, operatively coupled to said alarm time setting circuit, and storing said alarm time;

a fast forwarding control circuit, operatively coupled to said press-and-hold-down input detecting circuit and said alarm time setting circuit, to fast forward the alarm time by operating said alarm setting circuit for a press-and-hold-down input time while said press-and-hold-down input detecting circuit is detecting a press-and-hold-down input;

an alarm coincidence detecting circuit, operatively coupled to said clock timing circuit and said alarm time storing circuit, and providing an output to said fast forwarding control circuit to stop said fast forwarding control circuit when it is detected that the alarm time stored in said alarm time storing circuit coincides with the basic time;

an alarm sounding circuit;

an alarm setting/resetting circuit, operatively coupled to said alarm time setting circuit, said alarm coincidence detecting circuit to be in a set state when said alarm coincidence detecting circuit detects that said basic time and said alarm time do not coincide with each other, and to be in a reset state when said alarm coincidence detecting circuit detects coincidence between said basic time and said alarm time, said alarm time setting circuit is in operation, and said alarm sounding circuit is actuated after setting, to store said basic time in said alarm time storing circuit; and an alarm sounding control circuit, operatively coupled to said alarm setting/resetting circuit and alarm sounding circuit, actuating said alarm sounding circuit to sound said alarm after said alarm setting/resetting circuit is set and said alarm coincidence detecting circuit detects the coincidence between said basic time and said alarm time.

11. A method for setting an alarm time in an electronic clock, comprising:

providing a switch input;

providing said electronic clock with a first mode in which an alarm time may be set, and a second mode in which said alarm time is prevented from being set;

counting the duration during which the basic time coincides with the alarm time when said electronic clock is in said first mode; and changing said electronic clock from said first mode to said second mode when said duration reaches a predetermined value.

12. The method for setting the alarm time as claimed in claim 11, wherein said first mode is effected by triggering a switch input twice intermittently.

13. The method for setting the alarm time as claimed in claim 11, wherein said first mode is effected by triggering a switch input continuously for a predetermined time.

14. The method for setting the alarm time as claimed in claim 12, wherein said first mode is effected by operating one of a first external control switch and a second external control switch, incrementing said alarm time by one unit of time by operating said first external control switch, and decrementing said alarm time by one unit of time by operating said second external control switch.

15. A method for setting an alarm time in an electronic clock, comprising:

detecting an input;

one of incrementing and decrementing an alarm time by one unit if said input is an edge input;

fast forwarding said alarm time if said detected input is a press-and-hold-down input; and stopping the fast forwarding of said alarm time when coincidence between said alarm time and a basic time is detected.

16. The method for setting an alarm time as claimed in claim 15, wherein said incrementing of said alarm time is executed by triggering a first external control switch and said decrementing of said alarm time is executed by triggering a second external input.

* * * * *